US007802856B2

(12) United States Patent
Hashemi et al.

(10) Patent No.: US 7,802,856 B2
(45) Date of Patent: Sep. 28, 2010

(54) DRAWER SLIDE WITH PUSH-LATCH DEVICE

(75) Inventors: Darush David Hashemi, Trabuco Canyon, CA (US); Atma Kainth Singh, Fullerton, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 698 days.

(21) Appl. No.: 11/586,794

(22) Filed: Oct. 25, 2006

(65) Prior Publication Data

US 2007/0090735 A1 Apr. 26, 2007

Related U.S. Application Data

(60) Provisional application No. 60/730,049, filed on Oct. 25, 2005, provisional application No. 60/751,034, filed on Dec. 16, 2005.

(51) Int. Cl.
*A47B 88/00* (2006.01)

(52) U.S. Cl. ..... 312/334.46; 312/333; 312/334.44; 312/319.1

(58) Field of Classification Search ..... 312/333, 312/334.44, 334.46, 319.1; 384/21
See application file for complete search history.

(56) References Cited

U.S. PATENT DOCUMENTS

| | | | | |
|---|---|---|---|---|
| 1,461,525 | A * | 7/1923 | Hall | 312/203 |
| 2,637,576 | A * | 5/1953 | Nottingham | 292/99 |
| 3,451,702 | A | 6/1969 | Little | |
| 3,584,907 | A | 6/1971 | Mertes | |
| 3,603,631 | A | 9/1971 | White | |
| 3,700,301 | A | 10/1972 | Boeck | |
| 4,159,153 | A | 6/1979 | Yoshikawa | |
| 4,182,539 | A * | 1/1980 | Busch | 312/333 |
| 4,215,884 | A | 8/1980 | Little | |
| 4,657,292 | A | 4/1987 | Bruck | |
| 5,033,805 | A * | 7/1991 | Hobbs | 312/334.11 |
| 5,386,636 | A | 2/1995 | Asano | |
| 6,155,661 | A * | 12/2000 | O'Neil et al. | 312/334.44 |
| 6,652,050 | B2 * | 11/2003 | Lin | 312/333 |

(Continued)

FOREIGN PATENT DOCUMENTS

| | | |
|---|---|---|
| JP | 48-60829 | 8/1973 |

OTHER PUBLICATIONS

International Search Report dated Mar. 23, 2007 for International Patent Application No. PCT/US2006/041750, International Search Report mailed Aug. 14, 2007 (2pgs.).

(Continued)

*Primary Examiner*—Janet M Wilkens
*Assistant Examiner*—Dan Rohrhoff
(74) *Attorney, Agent, or Firm*—Christie, Parker & Hale, LLP

(57) ABSTRACT

A drawer slide includes an outer slide, an inner slide moveable relative to the outer slide between a closed position and an extended position, a first engagement member, a second engagement member moveable by engagement with the first engagement member between a latched position to latch the inner slide in the closed position and an unlatched position disengaged from the second engagement member, and a first spring coupled to any one of the outer slide and the inner slide and configured to bias the inner slide to the extended position when the inner slide is proximate to the closed position.

24 Claims, 17 Drawing Sheets

U.S. PATENT DOCUMENTS

| | | | | |
|---|---|---|---|---|
| 6,799,817 | B1 * | 10/2004 | Chu | 312/333 |
| 6,899,361 | B2 | 5/2005 | Dorn | |
| 6,926,377 | B2 * | 8/2005 | Lammens et al. | 312/333 |
| 6,997,528 | B2 * | 2/2006 | Yang | 312/333 |
| 7,104,691 | B2 * | 9/2006 | Chi | 384/21 |
| 7,159,958 | B1 * | 1/2007 | Lu | 312/334.44 |
| 7,192,103 | B2 * | 3/2007 | Hamilton | 312/334.5 |
| 7,347,515 | B1 * | 3/2008 | Lu | 312/333 |
| 2004/0212283 | A1 * | 10/2004 | Gasser | 312/333 |
| 2005/0025400 | A1 * | 2/2005 | Chi | 384/18 |
| 2007/0046158 | A1 * | 3/2007 | Hoffman | 312/333 |

OTHER PUBLICATIONS

Written Opinion of the International Searching Authority for International Patent Application No. PCT/US2006/041750, Written Opinion of the International Searching Authority mailed Aug. 14, 2007 (3 pgs.).

* cited by examiner

DRAWER SLIDE WITH PUSH-LATCH DEVICE

CROSS-REFERENCE TO RELATED APPLICATION(S)

The present application claims the benefit of U.S. Provisional Patent Application Ser. No. 60/730,049, filed Oct. 25, 2005, and claims the benefit of U.S. Provisional Patent Application Ser. No. 60/751,034, filed Dec. 16, 2005, the disclosures of which are incorporated herein by reference.

BACKGROUND

The present invention relates generally to drawer slides, and more particularly to a drawer slide with a push-latch device.

Drawer slides are ubiquitous in cabinets, cabinet type structures, and rack mounted applications. In general, drawer slides are useful in providing extensible attachment of items to structures. Drawer slides are available in a number of configurations, including telescopic drawer slides, over and under drawer slides, undermount drawer slides, and other types of drawer slides. Often the members of the drawer slides are extendably coupled by ball bearings or the like to allow for smooth extension of the drawer slide member, although drawer slides in which the members directly engage each other are also used.

Discussing drawers for convenience, drawer slides are often used to extendably attach drawers and the like to cabinets, with extension of the drawer from the cabinet allowing for easy access to the contents of the drawer. It is often desirable that a mechanism be provided so that a drawer is maintained in the closed position with respect to a cabinet absent application of a positive force to open the drawer. Preferably such a mechanism does not add to the space required for the drawer slide and any associated elements as any excess space required by the drawer slide and any associated elements reduces the amount of space available for the drawer.

At times a detent, providing a frictional interface, performs such a function, and does so without utilizing significant additional space. The detent may be placed along a slide's range of travel approximate the closed position, such that both fully closing and beginning to open the slide requires force to overcome the frictional interface provided by the detent. Once closed, therefore, the slide member, and the drawer to which it is attached, remain in the closed position until the drawer is pulled with sufficient force to overcome the frictional interface.

The desired frictional interface often depends on a variety of considerations, such as expected loading of the drawer and other factors, and specific detent designs are generally required for different applications. Moreover, manufacturing variations may also introduce significant variations in detent performance. In addition, often handles and the like are required on the drawer to allow users to easily open drawers kept closed by detents, and in a variety of applications handles may be aesthetically unpleasing or, such as the case of medical applications, undesirable for functional reasons, such as is often the case in medical settings.

Self-closing drawer slides are also known, such as self-closing slides which use a spring to assist in pulling a drawer to the closed position. In such instances the force of the spring, which is in the same direction as the line of travel of the slide, may keep the drawer in the closed position until application of a counteracting force. Unfortunately, springs used in self-close applications often are required to be able to close a drawer regardless of whether the drawer is lightly loaded or heavily loaded, with heavily loaded drawers generally requiring increased spring forces to drive the drawer closed. Accordingly, opening the drawer may require excessive force, particularly for lightly loaded drawers. In addition, as with a detent, a handle will often be required to pull the drawer open.

Locking mechanisms may also be used to keep drawers in a closed position. Locking mechanisms, however, generally require manipulation to unlock the drawer. Such manipulation may require dexterous use of one's fingers, and possibly insertion of digits into tightly bound spaces.

SUMMARY

In accordance with an aspect of the disclosure, a drawer slide includes an outer slide, an inner slide moveable relative to the outer slide between a closed position and an extended position, a first engagement member, a second engagement member moveable by engagement with the first engagement member between a latched position to latch the inner slide in the closed position and an unlatched position disengaged from the first engagement member, and a first spring coupled to any one of the outer slide and the inner slide and configured to bias the inner slide to the extended position when the inner slide is proximate to the closed position.

In accordance with another aspect of the disclosure, a drawer slide includes an outer slide, an inner slide moveably coupled to the outer slide between a closed position and an extended position, a first engagement member coupled to the inner slide, and a guide block coupled to a rear portion of the outer slide. The guide block includes a first spring configured to bias the inner slide to the extended position when the inner slide is proximate to the closed position, a second engagement member moveable in a first direction and a second direction, the second direction being opposite the first direction, the second engagement member having a ramped front projection configured to engage the first engagement member of the inner slide and a basin disposed to the rear of the front projection and configured to receive the first engagement member, and at least a second spring configured to bias the movement of the second engagement member in any one of the first direction and second direction. The first engagement member is configured to move the second engagement member in the first direction by the first engagement member sliding along the ramped front projection against the bias of the at least one second spring as the inner slide is moved proximate to the closed position. Additionally, the first engagement member is received in the basin when the inner slide is in the closed position. Furthermore, the first spring biases the inner slide to the extended position when the first engagement member is outside the basin.

In accordance with another aspect of the disclosure, a drawer slide includes an outer slide and an inner slide moveable relative to the outer slide along an extension direction between a closed position and an extended position. The drawer slide further includes means for latching and unlatching the inner slide relative to the outer slide, the means for latching and unlatching comprising a first engagement member configured to move along the extension direction and a second member configured to move transverse to the extension direction, the first engagement member configured to engage with the second engagement member in the closed position and configured to disengage from the second engagement member in the extended position. The drawer slide also includes at least a first spring coupled to any one of the outer slide and the inner slide and configured to bias the inner slide to the extended position when the inner slide is proximate to the closed position.

DETAILED DESCRIPTION

Figure 1:
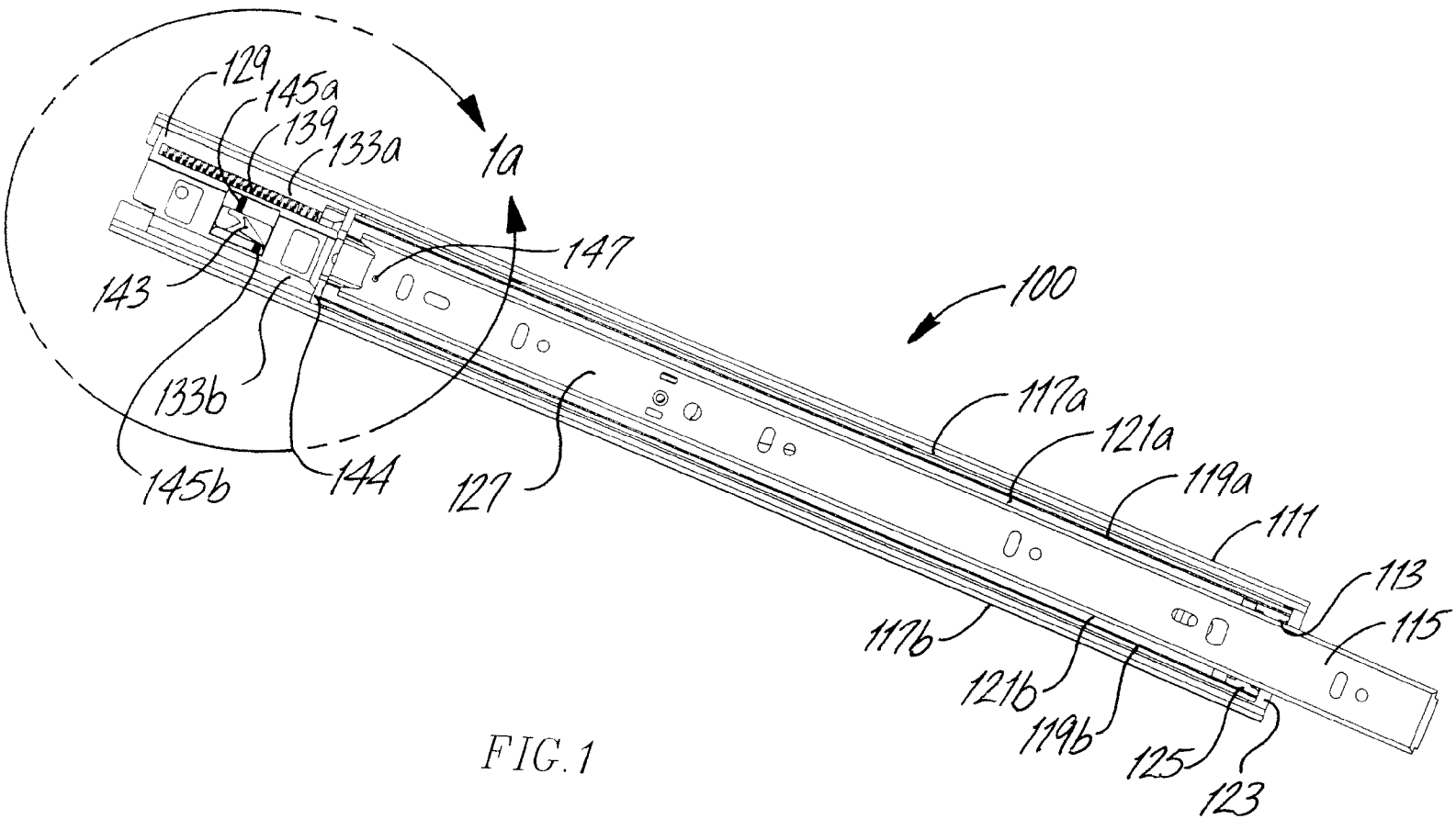
FIG. 1 illustrates a drawer slide with a push-latch device in accordance with aspects of the invention.

FIG. 1 illustrates a drawer slide 100 with a push-latch device in accordance with one aspect of the invention. As illustrated, the drawer slide 100 of FIG. 1 is a three member telescopic drawer slide, although in various embodiments two member telescopic drawers slides, over and under drawer slides, or undermount drawer slides are used (shown in FIG. 9 and described in detail herein). The illustrated three member telescopic drawer slide includes an outer slide member 111, an intermediate slide member 113, and an inner slide member 115. Each of the outer slide member 111, intermediate slide member 113, and the inner slide member 115 includes opposing bearing raceways 117*a,b*, 119*a,b*, 121*a,b*, along lengthwise sides of a longitudinal web 123, 125, 127, respectively. The intermediate slide member 113 is nested within the raceways 117*a,b* of the outer slide member 111, and the inner slide member 115 is nested within the raceways of the intermediate member 119*a,b*. Bearings (not shown) may run in the raceways to extendably couple the slide members 111, 113 and 115.

Generally the outer slide member 111 is affixed to a cabinet (not shown) and the inner member 115 is affixed to a drawer. The web 123 of the outer slide member 111 may be affixed to a sidewall of the cabinet. For example, brackets (not shown) can be used to affix the outer slide member 111 to a cabinet wall or frame, such as in face frame cabinets, or to a chassis, as in rack mounted applications. Similarly, the web 127 of the inner slide member 115 may be affixed to a side of a drawer (not shown) via various mounting mechanisms, or to items of equipment such as a computer cage (not shown).

Figure 2:
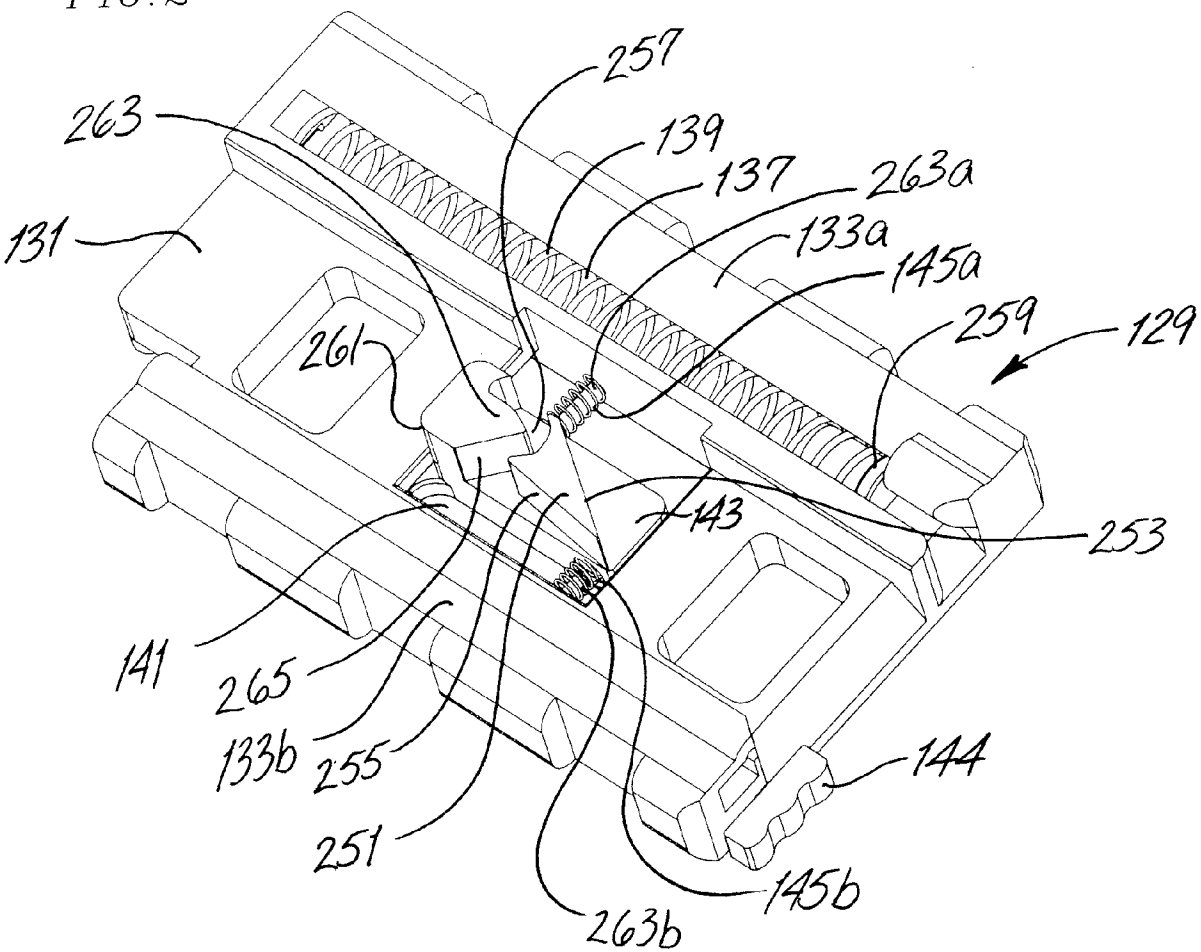
FIG. 2 illustrates a perspective view of a guide block for the push-latch device of FIG. 1.
Figure 9:
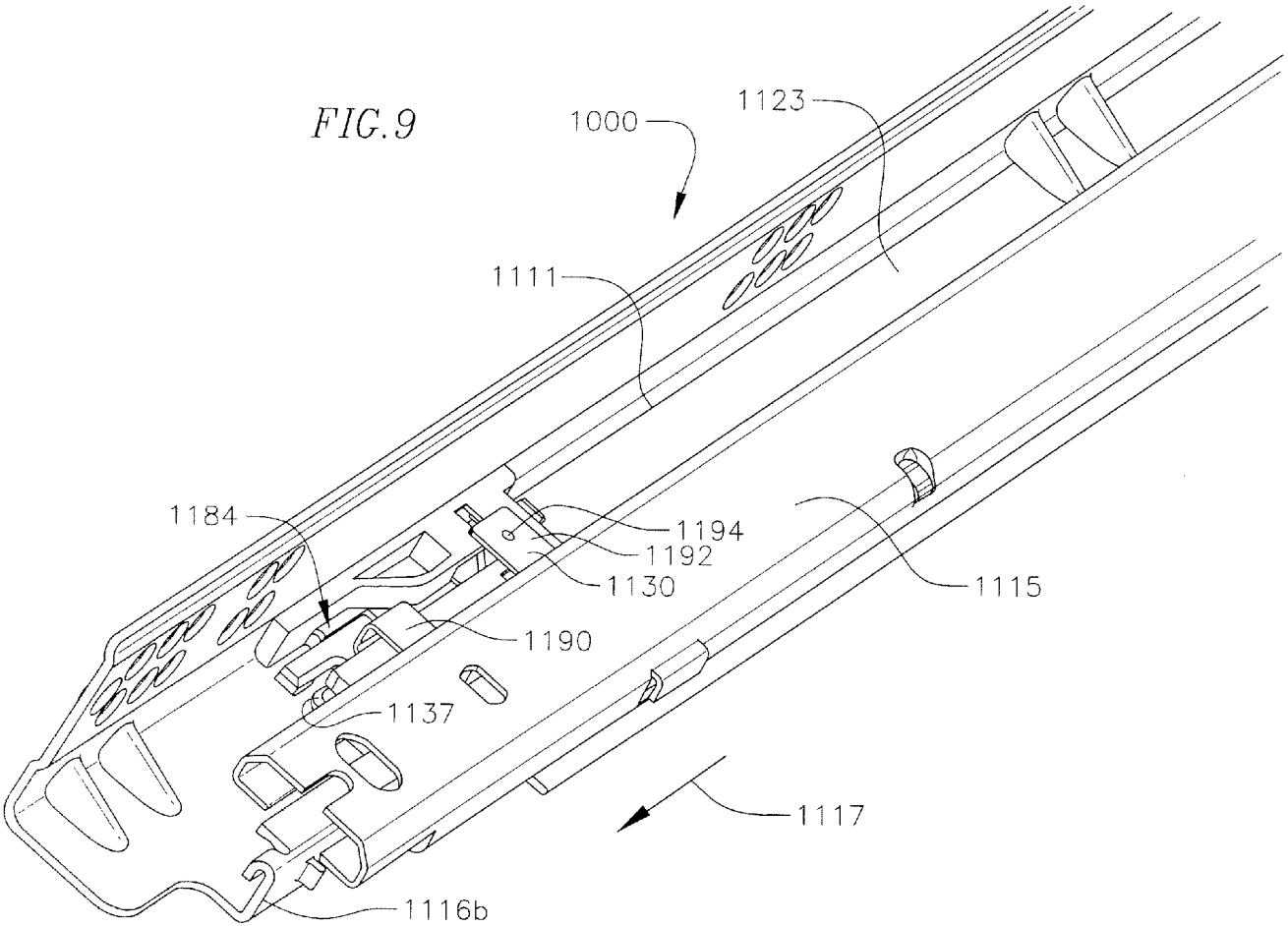
FIG. 9 illustrates an undermount drawer slide with a push-latch device in accordance with aspects of the invention.

The outer slide member 111 carries a guide block 129 that is nested between the raceways 117*a,b* approximate to one of the longitudinal ends of the outer slide member 111. The noted longitudinal end corresponds to the end that is to be positioned at a rear of a cabinet, a rack or a like structure in which the outer slide member 111 is mounted. The guide block 129 may be attached to the web 123 of the outer slide member 111 For example, the guide block 129 can be sized and configured to attach to the web 123 between the raceways 117*a,b* by a snap-in connection. The snap-in connection may be facilitated by frictional attachment of the guide block 129 to the raceways 117*a,b* of the outer slide member 111. Alternatively, the snap-in connection can be facilitated by a plurality of projections or tabs on the guide block 129 engaging corresponding apertures on the outer slide member 111. The guide block 129 includes longitudinally oriented portions 133*a,b* that are configured to generally fit between the raceways 117*a,b* of the outer slide member 111. In various embodiments, the portions 133*a,b* may be generally cylindrical, semi-cylindrical, rectangular or any other shape. The shape of the portions 133*a,b* and the dimension of these portions are configured so as to be capable of accommodating and guiding the raceways 121*a,b* of the inner slide member 115. In the examples of FIGS. 1, 2 and 9, the raceways 121*a,b* have an arcuate shape and may be referred to herein as arcuate raceways 121*a,b*. Accordingly, the portions 133*a,b* may have a generally cylindrical or semi-cylindrical shape to accommodate the arcuate raceways 121*a,b*.

In addition to any other function described herein, in some embodiments, the guide block 129 can provide the function of controlling the vertical movement or deflection of the inner slide member 115 relative to the outer slide member 111. Accordingly, the portions 133*a,b* of the guide block 129 may be shaped to correspond to the shape of the raceways 121*a,b* of the inner slide member 115 to control the vertical position of the inner slide member 115 relative to the outer slide member 111 upon the inner slide member 115 reaching a closed position.

In most embodiments, the guide block 129 has sufficient thickness or height to block rearward movement of the intermediate slide member 113 past the guide block 129. The guide block 129 also includes a bumper 144 (shown in FIGS. 1, 1*a* and 2) that faces the intermediate slide member 113. In addition to absorbing some of the force of impact between the intermediate slide member 113 and the guide block 129, the bumper 144 can also substantially silence such an impact.

Figure 1A:
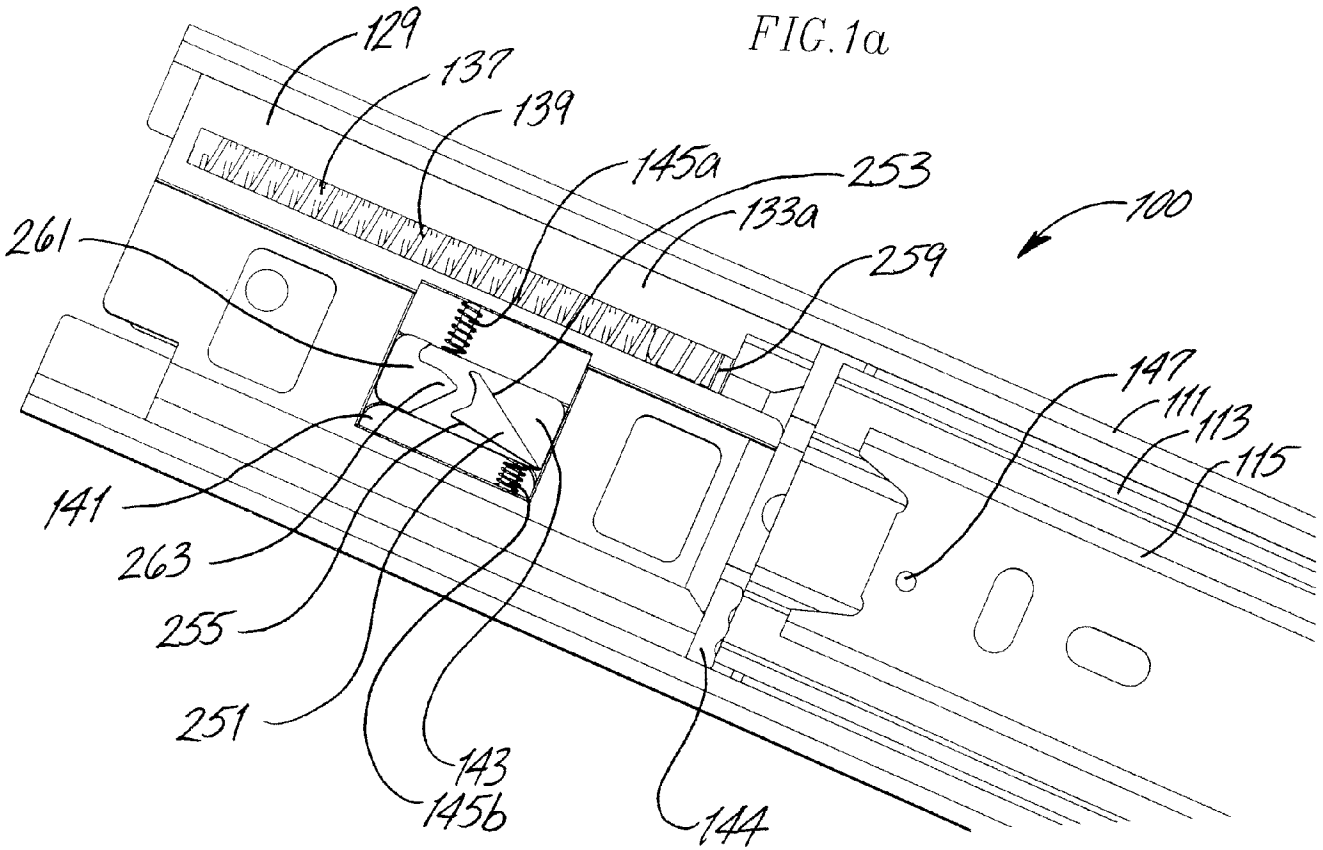
FIG. 1*a* illustrates an enlarged view of area 1*a* of FIG. 1.

Referring to FIG. 1*a*, the guide block also includes a slotted cavity 137 in one of the cylindrical portions 133*a,b*, with the slotted cavity 137 extending in the longitudinal direction with respect to the outer slide member. The slot of the slotted cavity 137 is positioned such that an arcuate raceway 117*a* or 117*b* of the inner slide member 115 may enter the slotted cavity 137, with the raceway extending through the slot. In the disclosed examples, the slotted cavity 137 is shown to be in the portion 133*a*. A spring 139 is positioned longitudinally within the slotted cavity 137, such that entry of the raceway into the slotted cavity 137 compresses the spring 139. As indicated below, the spring 139 provides a self-opening feature to operation of the drawer slide, as well as assisting in latching of the drawer slide in the closed position, also as discussed below. Although the guide block 129 is shown to only have one slotted cavity 137 in the portion 133*a*, the portion 133*b* can also have a slotted cavity (not shown) that can accommodate a spring (not shown). Thus, another spring can be provided in the guide block 129 by which the self opening feature of the drawer slide can be further facilitated.

The web of the guide block includes a window 141. A moveable body 143 is positioned within the window 141, with the moveable body 143 generally moveable, or slidable, within the window 141 along an axis transverse to the longitudinal length and direction of extension of the slide. Opposing springs 145*a,b* generally maintain position of the moveable body 143 in what may be considered a neutral position. The opposing springs 145*a,b* each abut surfaces of the window 141 and of the surfaces of the moveable body 143. Accordingly, the resultant spring forces are transverse to the longitudinal length and direction of travel of the slides. Thus, if the slides are viewed as extending in a horizontal direction and having their webs mounted to a vertical wall, as is often the case, then the moveable body 143 moves, or slides, vertically while the slides may extend horizontally.

The moveable body 143 interacts with a pin (not shown) that extends from the inner slide member 115. As illustrated, a base 147 of the pin may be seen in FIGS. 1 and 1*a*. The pin extends towards the outer slide member 111 from the web 127 of the inner slide member 115, and does so approximate to the rearward end of the inner slide member 115. Accordingly, the pin approaches the moveable body 143 of the guide block 129 as the inner slide member 115 moves towards the closed position. In operation, as the inner slide member 115 closes, the pin contacts a portion of the moveable body 143, causing the moveable body 143 to displace from its neutral position. Once the moveable body 143 is sufficiently displaced, it can retain the pin, thereby keeping the inner slide member 115 in the closed position. Forcing the inner slide member 115 further past the closed position allows the moveable body 143 to return to its neutral position and release the pin. Accordingly, the force of the spring 139 forces the inner slide member 115 to extendably translate with respect to the outer slide member 111.

Referring to FIG. 2, the moveable body 143 includes a projection 251 having a first surface forming a ramp 253, a second surface forming a slight reverse ramp 255, and a rearward concave depression 257. As the inner slide member 115 closes, the pin contacts the ramp 253, and forces the moveable body 143 to displace away from its neutral position. Once the pin clears the ramp 253, the moveable body 143 returns towards its neutral position, retaining the pin in the concave depression 257 in the back of the ramp 253.

The moveable body 143, however, does not reach its neutral position with the pin in the concave depression 257. Instead, the pin maintains the moveable body 143 in a biased position, such that if the pin were to be removed from the concave depression 257, the moveable body 143 would be returned, via action of the opposing springs 145*a,b*, to the neutral position. With the moveable body 143 in its neutral position, the pin is allowed to pass over the slight reverse ramp 255, freeing the inner slide member 115 to extend from the outer slide member 111 via the force of the spring 139.

As discussed above, the longitudinal spring 139 within the guide block 129 assists in retaining the pin in the concave depression 257. As the spring 139 urges the inner slide member 115 forward, the pin is pressed into and against the concave depression 257. Further application of the closing force, such as by pressing on a drawer coupled to the inner slide member 115, however, allows the pin to follow the contour of the concave depression 257 to leave the concave depression 257, freeing the moveable body 143 to return to its neutral position. Removal of the closing force then allows the spring 139 to force the inner slide member 115 forward, moving the pin past the moveable body 143 and forcing the inner slide 115 towards the open position.

FIG. 1*a* shows an enlarged view of area 1*a* of FIG. 1. The guide block 129 is fitted between the raceways 117*a,b* of the outer slide member 111. The intermediate slide member 113 abuts the guide block 129, with the guide block 129 serving as an inward stop for the intermediate slide member 113. The inner slide member 115, however, is allowed to pass over and into the guide block 129, with one raceway 119*b* guided by the portion 133*b* of the guide block 129 and one raceway 119*a* allowed to pass into the slotted cavity 137 of the guide block 129. The slotted cavity 137 includes the longitudinal spring 139 for urging the inner slide member 115 forward, with a cap 259 at the end of the spring 139 for improved contact with the inner slide member 115.

Referring to FIG. 2, the moveable body 143 includes a first projection 251 and a second projection 261 to the rear of the first projection 251. The second projection 261 includes a finger 263 pointing towards the first projection 251. The finger 263 assists in guiding the pin of the inner slide member 115 towards the concave depression 257 in the first projection 251 when the inner slide member 115 is being closed, and in guiding the pin out of engagement with the first projection 251 when the pin is disengaged from the concave depression 257.

As shown in FIG. 2, the first spring 145*a* is positioned towards the rear of the movable body 143. The first spring 145*a* is also coiled around a post 263*a*, which maintains the position of the spring 145*a* with respect to the moveable body 143. The second spring 145*b* is positioned towards the front of the moveable body 143. The second spring 145*b* is also coiled around a post 263*b*, which maintains the position of the spring 145*b* with respect to the moveable body 143. The posts 263*a,b* may be accommodated in corresponding cavities of the moveable body 143. Thus, in the embodiment of FIG. 2, the spring 145*a* is not axially aligned with the spring 145*b*. Such a configuration provides offset for the cavities which support the posts 263*a,b* so as to prevent any overlap or interference between the cavities 327*a,b* (shown in FIGS. 3*a* and 3*b*) inside the moveable body 143. In addition, the non-aligned position of the springs 145*a,b* may reduce the rotation of the moveable body 143 as the pin engages the ramps 253, 255. Further, when the pin releases from the concave depression 257, the non-aligned configuration of the springs 145*a,b* can aid in moving the first projection 251 out of the path of travel of the pin approximate to the first projection 251.

Figure 3A:
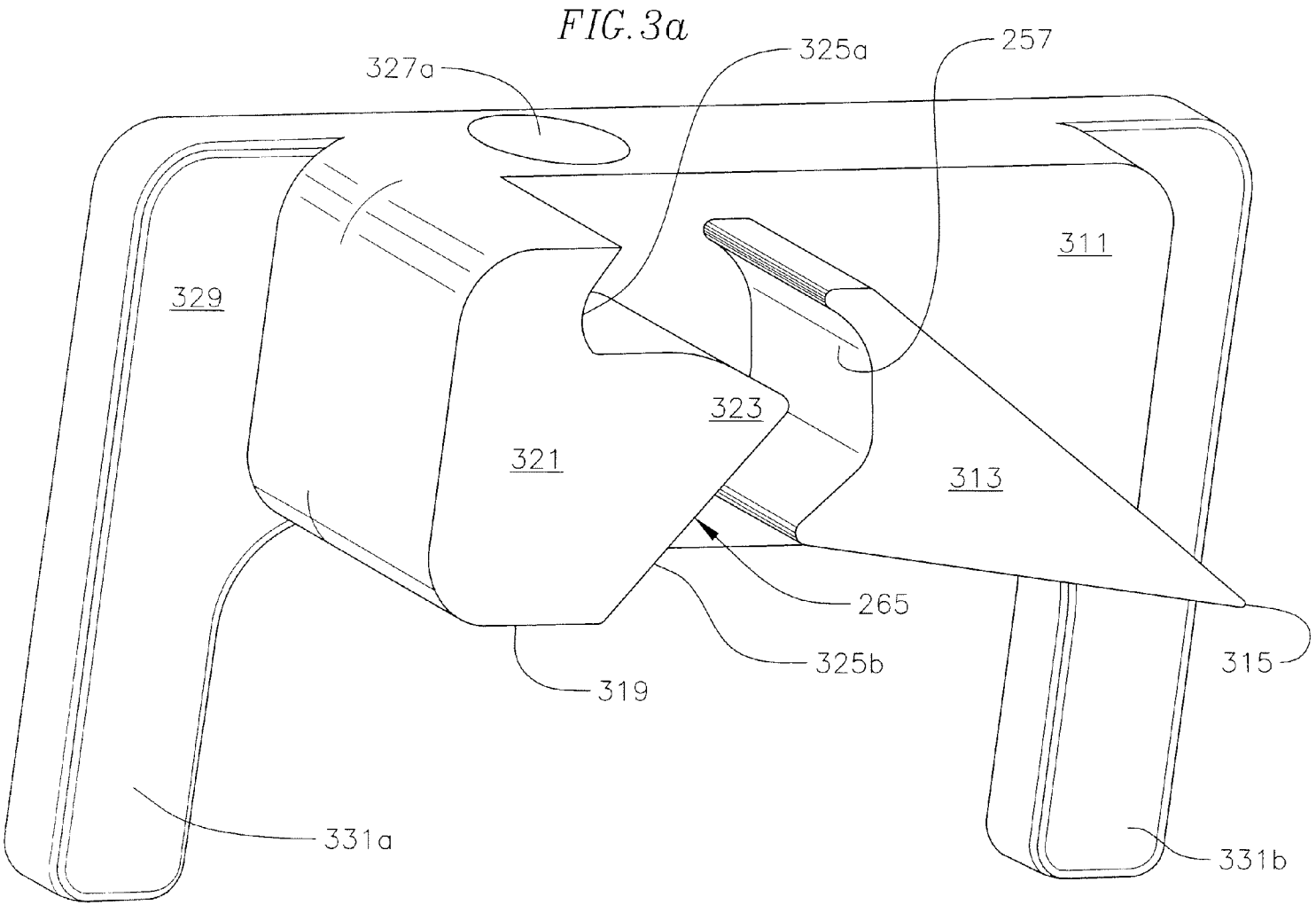
FIG. 3*a* illustrates a rear perspective view of a moveable body of the guide block of FIG. 2.
Figure 3B:
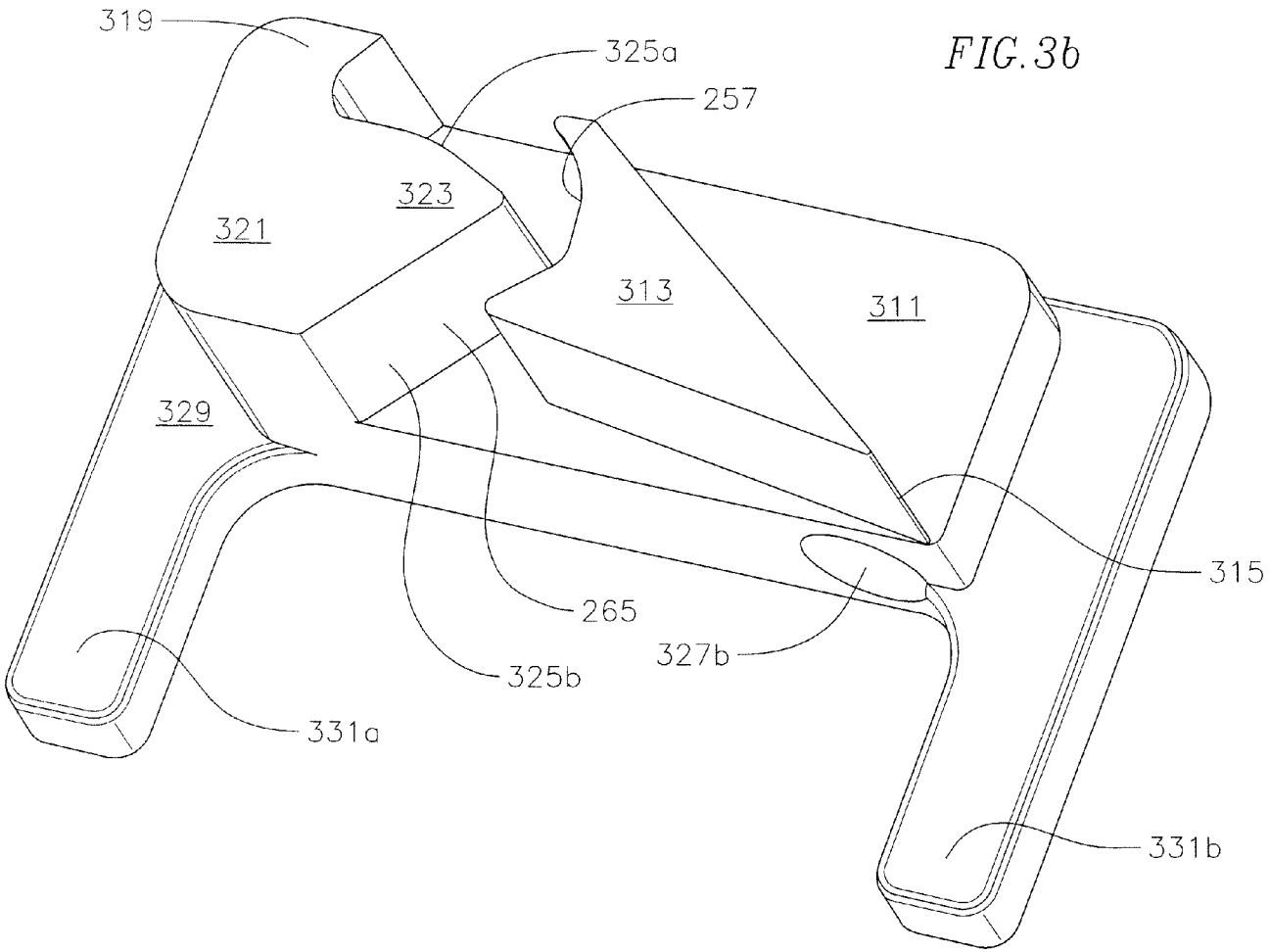
FIG. 3*b* illustrates a front perspective view of a moveable body of the guide block of FIG. 2.

Also as illustrated in FIG. 2, the moveable body 143 is in what may be considered a neutral position. In the neutral position, the springs 145*a,b* may be in the free state position or slightly counteract each other (with gravitational forces on the moveable body 143 having a small effect). In the neutral position, the ramp 253 of the first projection 251 is in the path of travel of the pin of the inner slide member 115. Therefore, the pin can engage the ramp 253 of the first projection 251 to move the moveable body 143 away from the neutral position against the bias of the spring 145*b*, while the spring 145*a* maintains a free state position. After the pin clears the ramp 253, the moveable body 143 is urged towards its neutral position by the force of the spring 145*b*. However, the concave depression 257 catches the pin. The concave depression 257 may have an edge away from the ramp extending farther rearward than the edge approximate the ramp 253. The pin accordingly keeps the moveable body 143 from fully returning to its neutral position. Once the inner slide member 115 is further pushed towards the closed position, the pin clears the concave depression 257. As shown in FIG. 2, 3*a* and 3*b*, the finger 263 is configured off center relative to the center of the concave depression 257 to provide an elongated ramp 265. When the inner slide member 115 is further pushed towards the closed position, the elongated ramp 265 aids in clearing the pin from the concave depression 257. The moveable body 143 then allows for passage of the pin on the ramp 255, and the longitudinal spring 139 urges the inner slide member 115, and the pin, forward past the moveable body 143 to extend the inner slide member 115 relative to the outer slide member 111.

FIGS. 3*a* and 3*b* illustrate an embodiment of the moveable body 143. The moveable body 143 includes a generally rectangular body 311. A triangular projection 313 extends from one face of the rectangular body 311. Although the projection 313 is shown to be triangular, it may have any other shape so as to be able to perform the functions thereof described herein. The projection 313 has an apex 315 pointing towards one corner of the rectangular body 311. The base of the triangular projection 313 has the concave depression 257.

A second projection 319 extends from the same face of the rectangular body 311. The second projection 319 includes a base 321 with an extending finger 323. The base 321 generally positioned towards the rear of the rectangular body 311 such that the finger 323 points towards the concave depression 257. The finger 323 assists the pin of the inner slide member 115 in properly seating in the concave depression 257. In addition, the base 321 includes catch basins 325*a,b* on either side of the pin. The catch basins 325*a,b* can limit rearward travel of the pin in the event excessive rearward force is applied to the inner slide member 115. The rectangular body 311 also includes a cavity 327*a,b* on a surface adjacent to the aforementioned face to accommodate the posts 263*a,b*.

Figure 11:
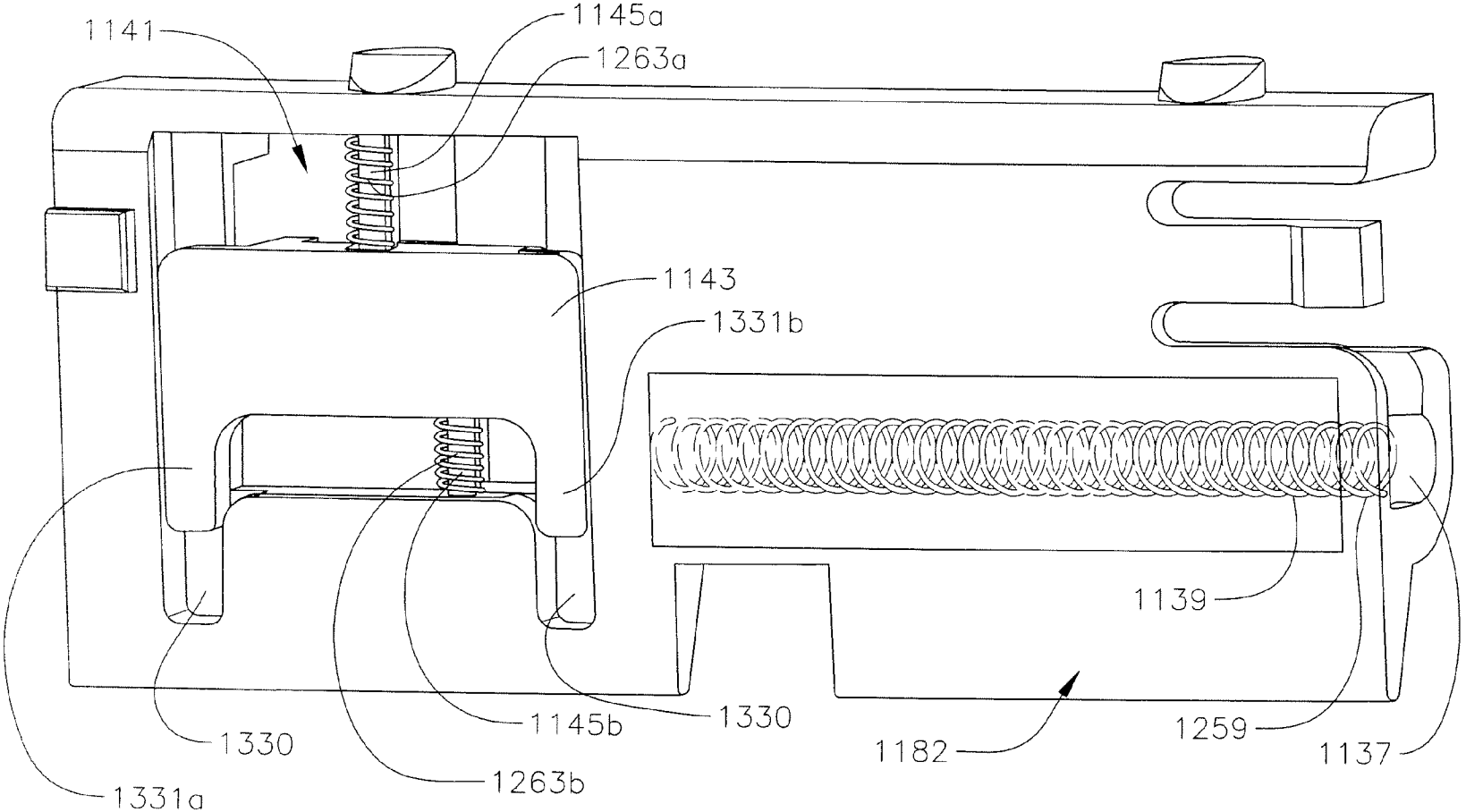
FIG. 11 illustrates a rear perspective view of a guide block for the push-latch device of FIG. 9.

As illustrated in FIGS. 3*a* and 3*b*, the rectangular body 311 is itself a projection from a planar backing 329. The backing 329 extends forward and rearward of the length of the rectangular body 311. The backing 329 also includes two legs 331*a,b*, extending in the same direction and in the same plane as the backing 329. In operation, the backing 329 serves to retain the rectangular body 311 in the window 141 of the guide block 129. Slots (an example of which is shown in FIG. 11 as slots 1330) may be provided about the window 141 in the guide block 129. The backing 329 and legs 331*a,b* are slidable within the slots, but sufficiently bound so as to limit motion of the rectangular body 311 away from the guide block 129.

Figure 4A:
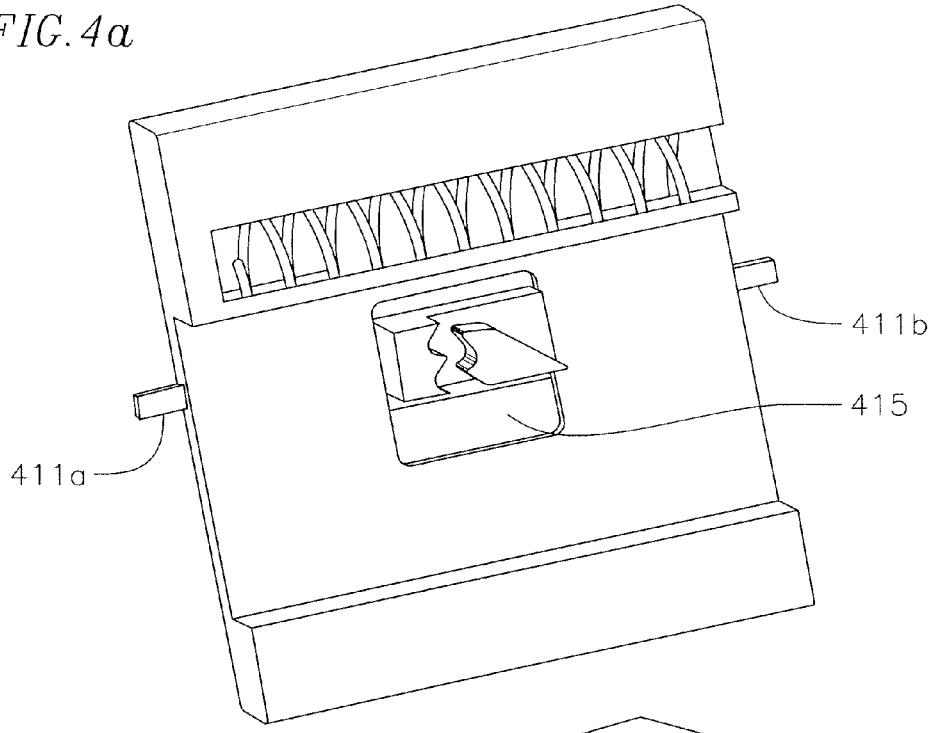
FIGS. 4*a* and 4*b* illustrate a further embodiment of a guide block and a movable body in accordance with aspects of the invention.
Figure 4B:
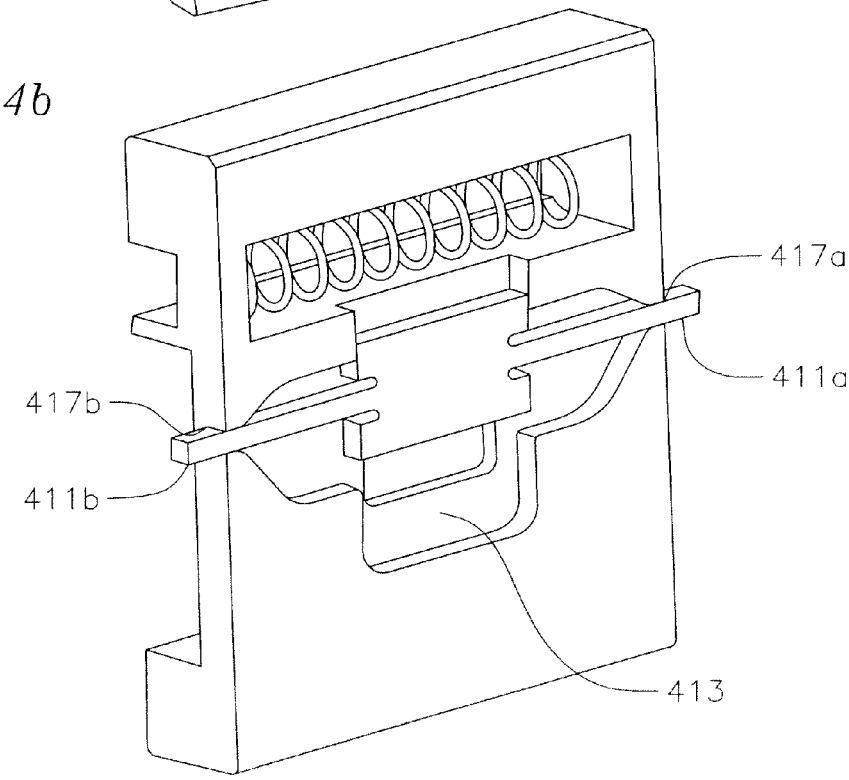

FIGS. 4*a* and 4*b* illustrate a further embodiment of a guide block and hold-in latching mechanism in accordance with aspects of the invention. In the embodiment of FIGS. 4*a* and 4*b* a leaf-spring like structure is provided by flexible legs 411*a,b* extending longitudinally from the rectangular body. The flexible legs extend from a backing of the moveable body. As may be seen in FIG. 4*b*, the flexible legs, and the backing, are largely within a cutout 413 about a window 415 of the guide block, with the flexible legs pinched or bound at points 417*a,b* away from the moveable body. Application of force on the moveable body, such as that described as applied by the pin of the inner slide member, causes the moveable body to translate and concomitant flexing or plastic deformation of the legs. The flexing of the legs provides a spring-like force opposite the direction of movement of the moveable body.

Figure 5A:
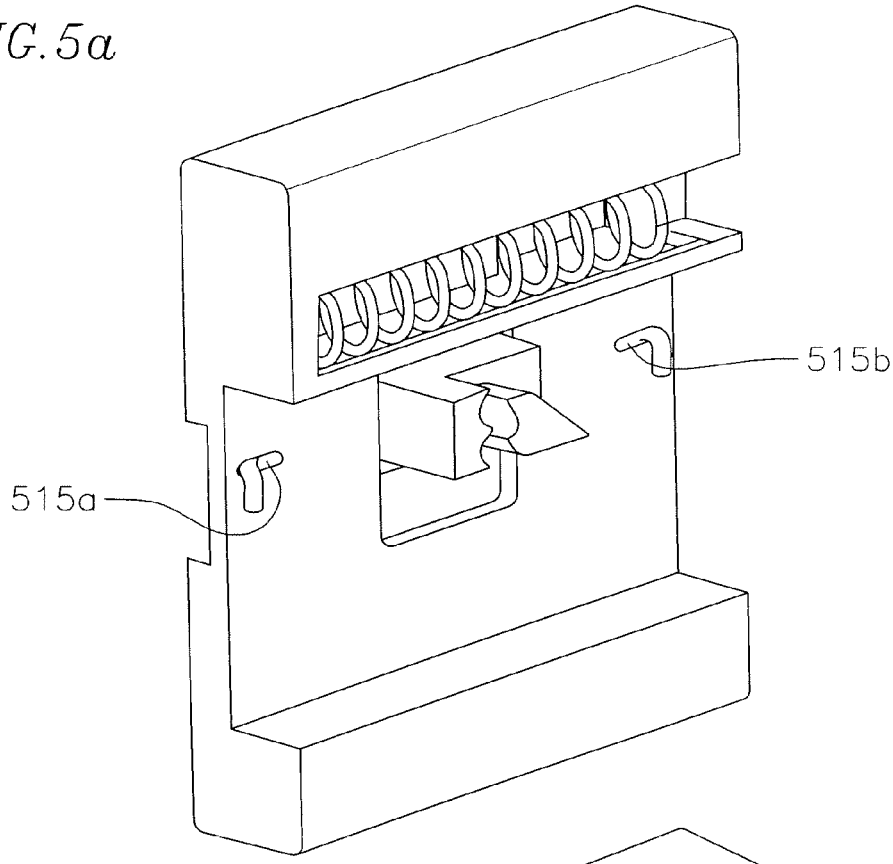
FIGS. 5*a* and 5*b* illustrate yet a further embodiment of a guide block and movable body in accordance with aspects of the invention.
Figure 5B:
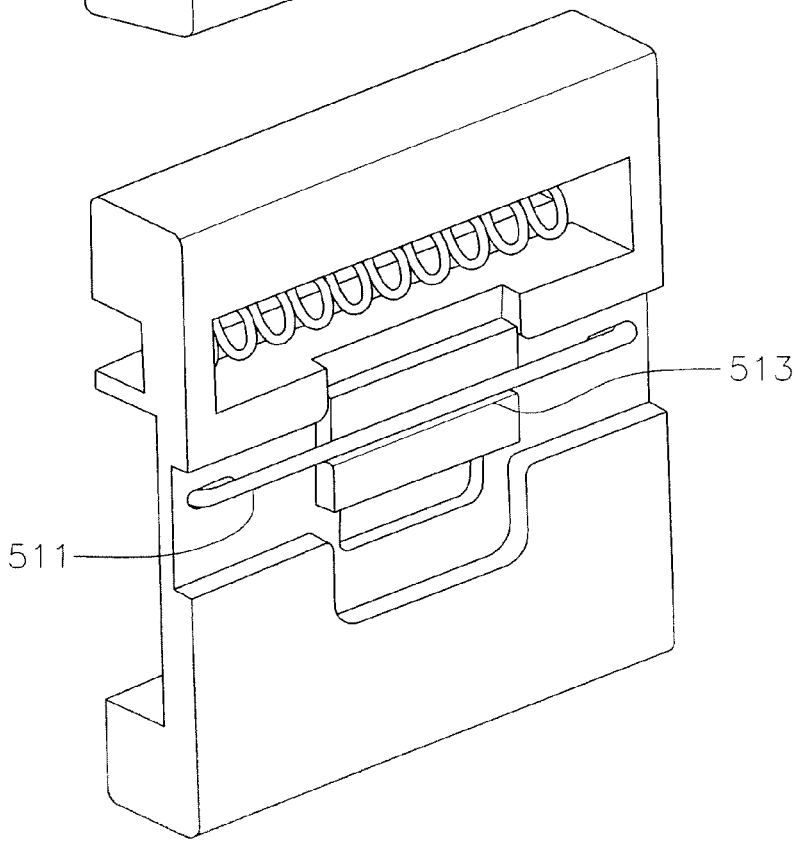

FIGS. 5*a* and 5*b* illustrate a further embodiment which has some similarities to the embodiment of FIGS. 4*a* and 4*b*. In the embodiment of FIGS. 5*a* and 5*b* a clip 511 or pin, possibly formed of metal, traverses a slot 513 in the backing of the moveable body in a lengthwise direction. The clip includes bent portions along its ends, with the bent portions inserted in small slots 515*a,b* in the guide block. The slots allow some motion of the clip with respect to the guide block, but the bent portions generally restrain motion of the clip. The clip, which in some embodiments may be considered a wire spring, also acts in a spring-like manner, and urges the moveable body towards a neutral position.

Figure 6A:
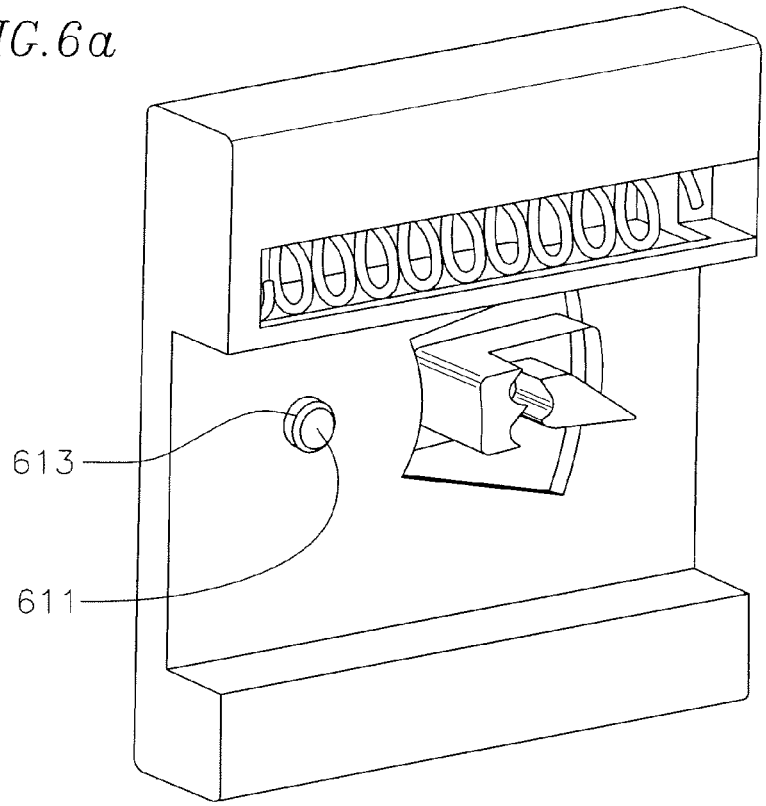
FIGS. 6*a* and 6*b* illustrate yet a still further embodiment of a guide block and movable body in accordance with aspects of the invention.
Figure 6B:
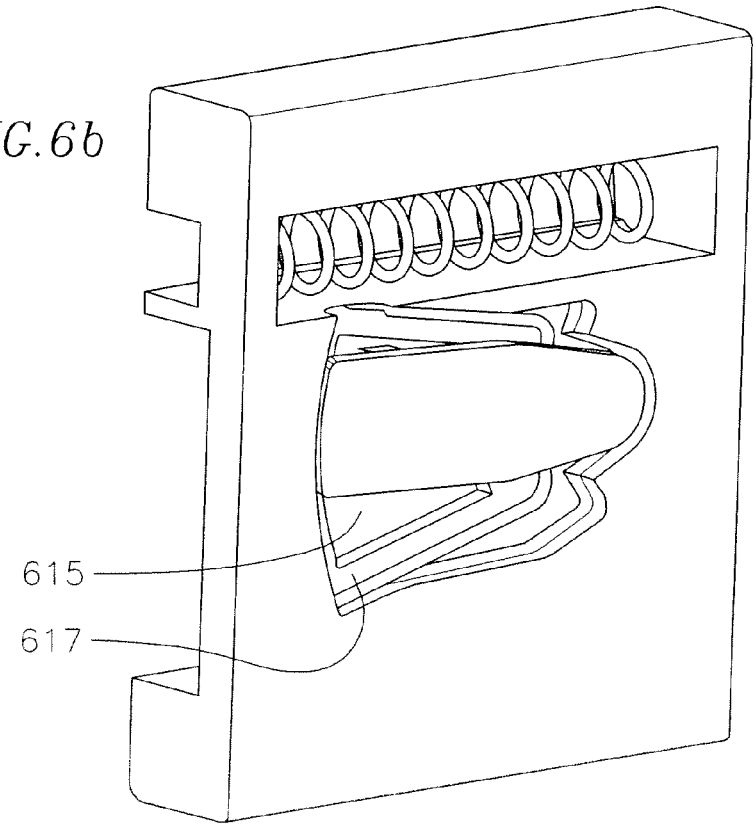

FIGS. 6*a* and 6*b* illustrate yet a further embodiment of the invention. In the embodiment of FIGS. 6*a* and 6*b* the moveable body pivots about a pivot point. The pivot point is provided by a post 611 of the moveable body that protrudes through the backing. The plug extends into an aperture 613 of the guide block, and the position of the plug is therefore fixed with respect to the guide block. The moveable body, however, is forward of the plug and moveable within a window 615 of the guide block, as is largely the backing within a cutout 617 of the guide block. In some embodiments a torsional spring biases the moveable body to a neutral position.

Figure 7A:
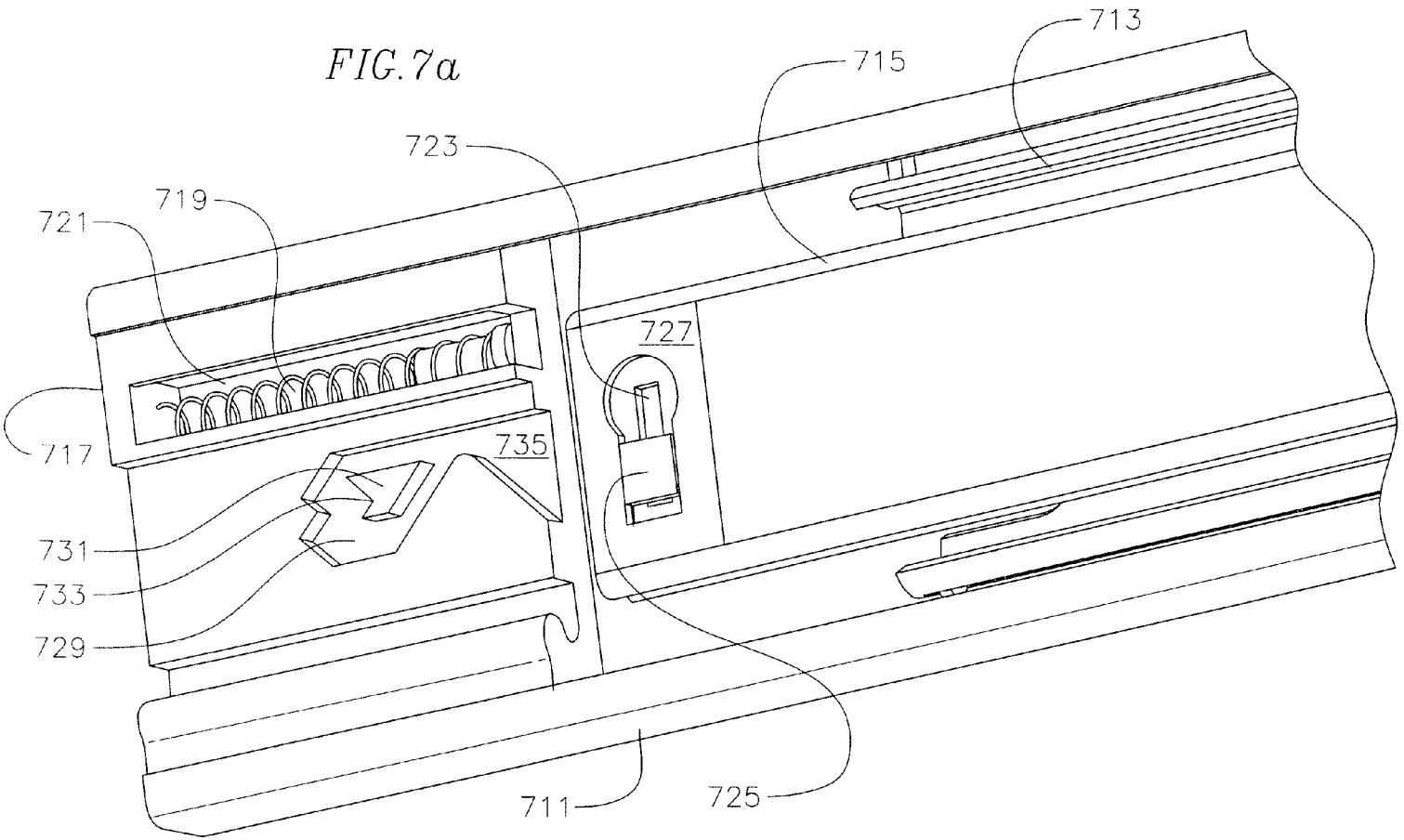
FIGS. 7*a* and 7*b* illustrate an embodiment of the invention with a guide pin coupled to an inner slide member with a guide block having a travel path for the guide pin.

FIG. 7*a* illustrates a further embodiment in accordance with aspects of the invention. The embodiment of FIG. 7*a* includes a three-member telescopic slide with an outer member 711, an intermediate member 713, and an inner member 715. A guide block 717 is positioned within raceways of the outer side member. The guide block includes a longitudinal spring 719 in a slot 721 configured to receive a raceway of the inner slide member.

The rear edge of the web of the inner slide member includes a keyhole slot 723 transverse to the longitudinal length of the inner slide member. A guide pin 725, or slider, is maintained in the keyhole slot. In the embodiment illustrated, the keyhole slot is in a plastic attachment 727 to the rear edge of the web of the inner slide member, and the attachment is configured to ride over the guide block.

Figure 7B:
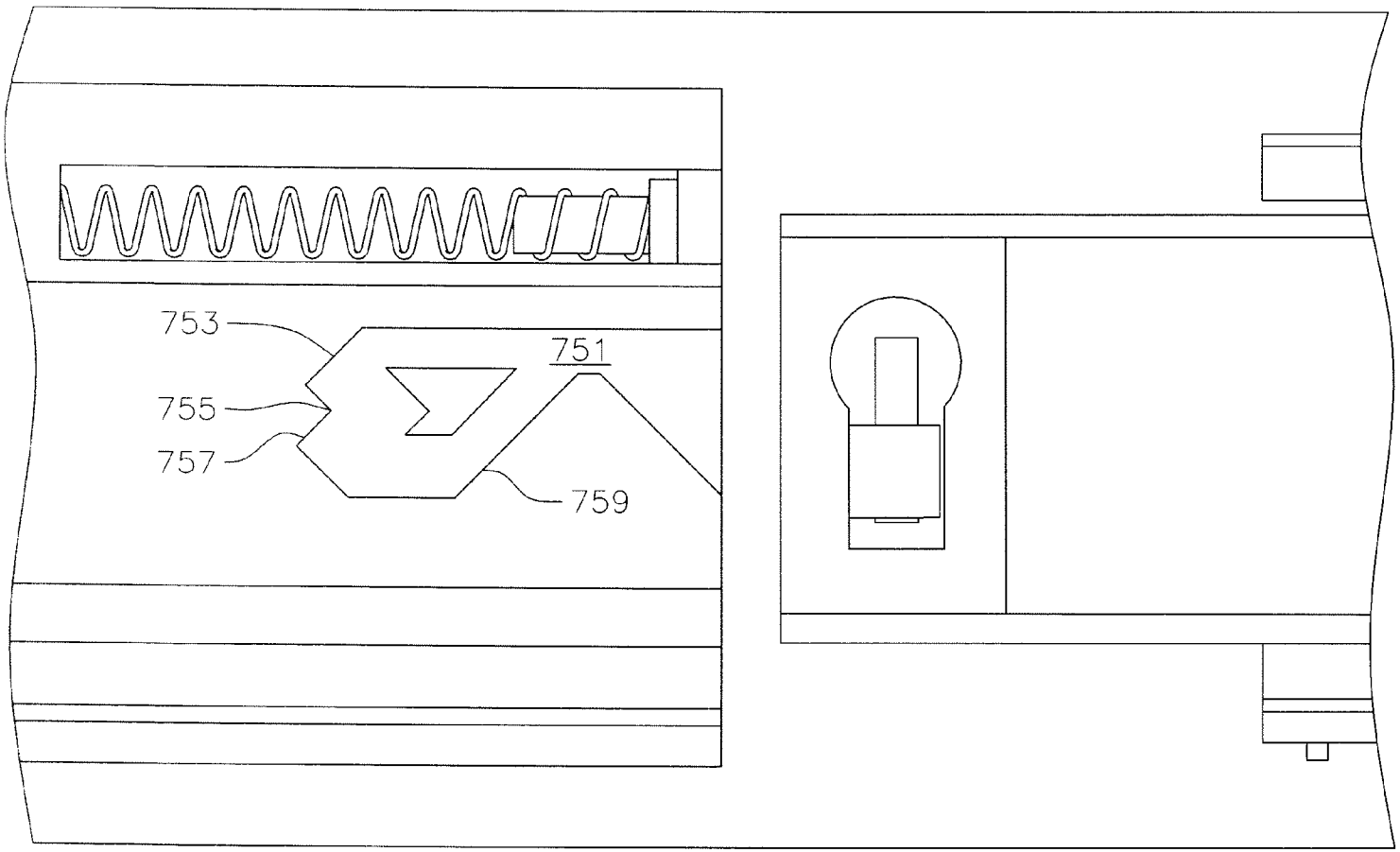

A somewhat circular pathway 729 is formed by a cutout in the guide block. The somewhat circular pathway circles a raised island 731 in the cutout. The raised island includes a recessed notch 733. The pathway opens to a base of a funnel opening 735, which opens to the front edge of the guide block. The funnel opening is configured to receive the guide pin of the inner slide member. In operation, the plastic attachment rides over the guide member as the drawer slide is closed, with the guide pin entering the funnel opening of the cutout of the guide block. The funnel opening of the guide block guides the guide pin towards and into the somewhat circular path of the cutout. As perhaps as can be better seen in FIG. 7*b*, the funnel opening narrows to a gap 751 between the funnel opening and the somewhat circular path formed by the cutout. As the inner slide member continues to move towards a closed position the guide pin passes through the gap and runs about the top surface of the cutout until it is forced to turn by a first ramping slope 753 towards the rear of the circular path.

The first ramping slope terminates in a finger 755 jutting out into the somewhat circular path. Release of the inner slide member with the guide pin at the edge of the finger results in the longitudinal spring pushing the inner slide member forward, thereby pushing the guide pin into the notched rear edge of the island. Force exerted by the longitudinal spring will cause the guide pin to remain in this notch, latching the inner slide member in a closed position.

Release of the inner slide member, by release of the guide pin from the notch, is accomplished by pressing or forcing the inner slide member further towards the rear. This causes the guide pin to engage a reverse slope 757 of the finger, moving the guide pin out of alignment with the notch on the rear of the island. Subsequent release of the inner slide member causes the spring to urge the inner slide member forward, with the guide pin passing under the island, contacting an upward slope 759 of the path forcing the guide pin to the gap and out the funnel opening.

Figure 8A:
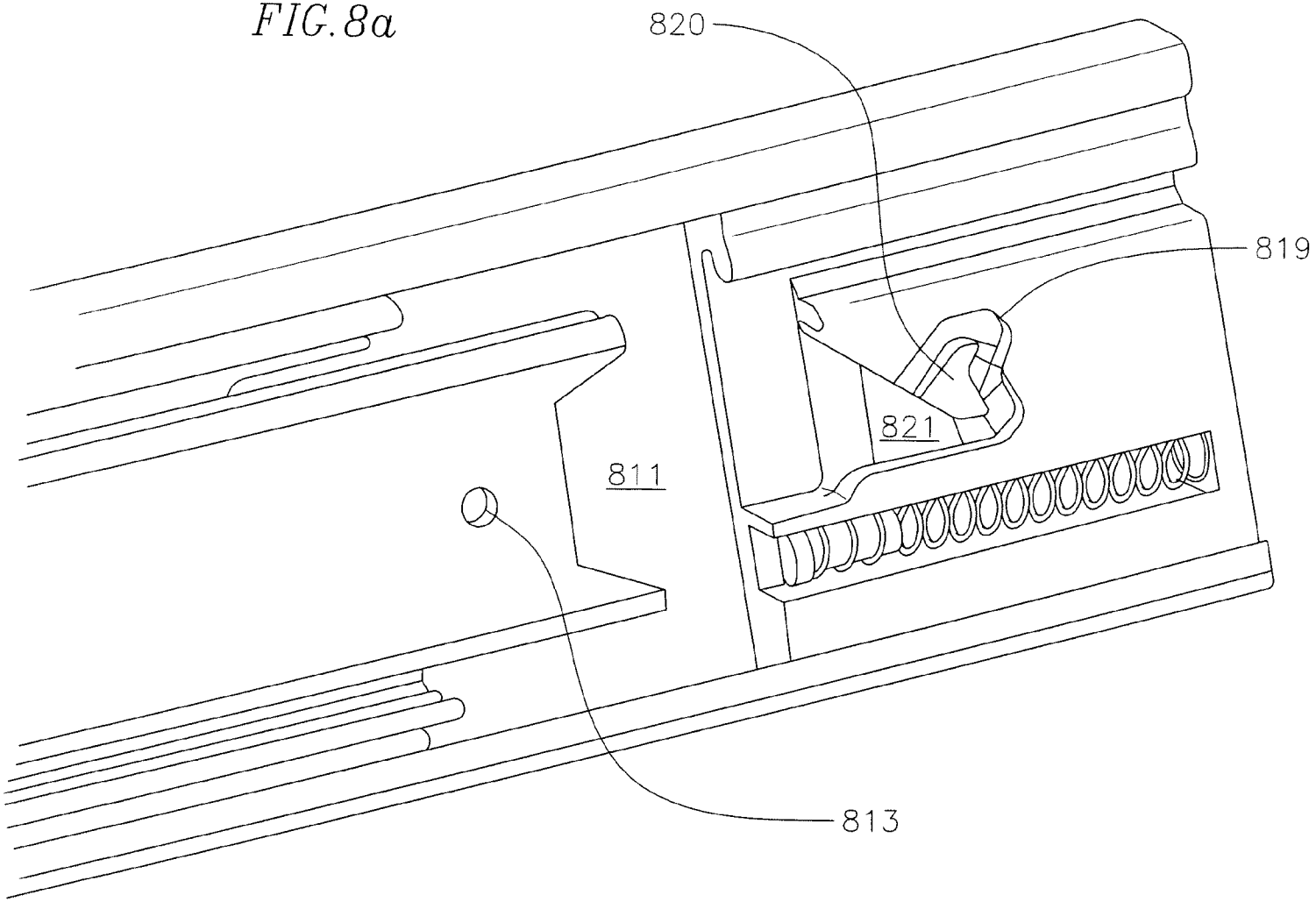
FIGS. 8*a* and 8*b* illustrate a further embodiment of the invention having a biasable arm coupled to the inner drawer slide and configured to follow a segmented path in a cut out of a guide block.
Figure 8B:
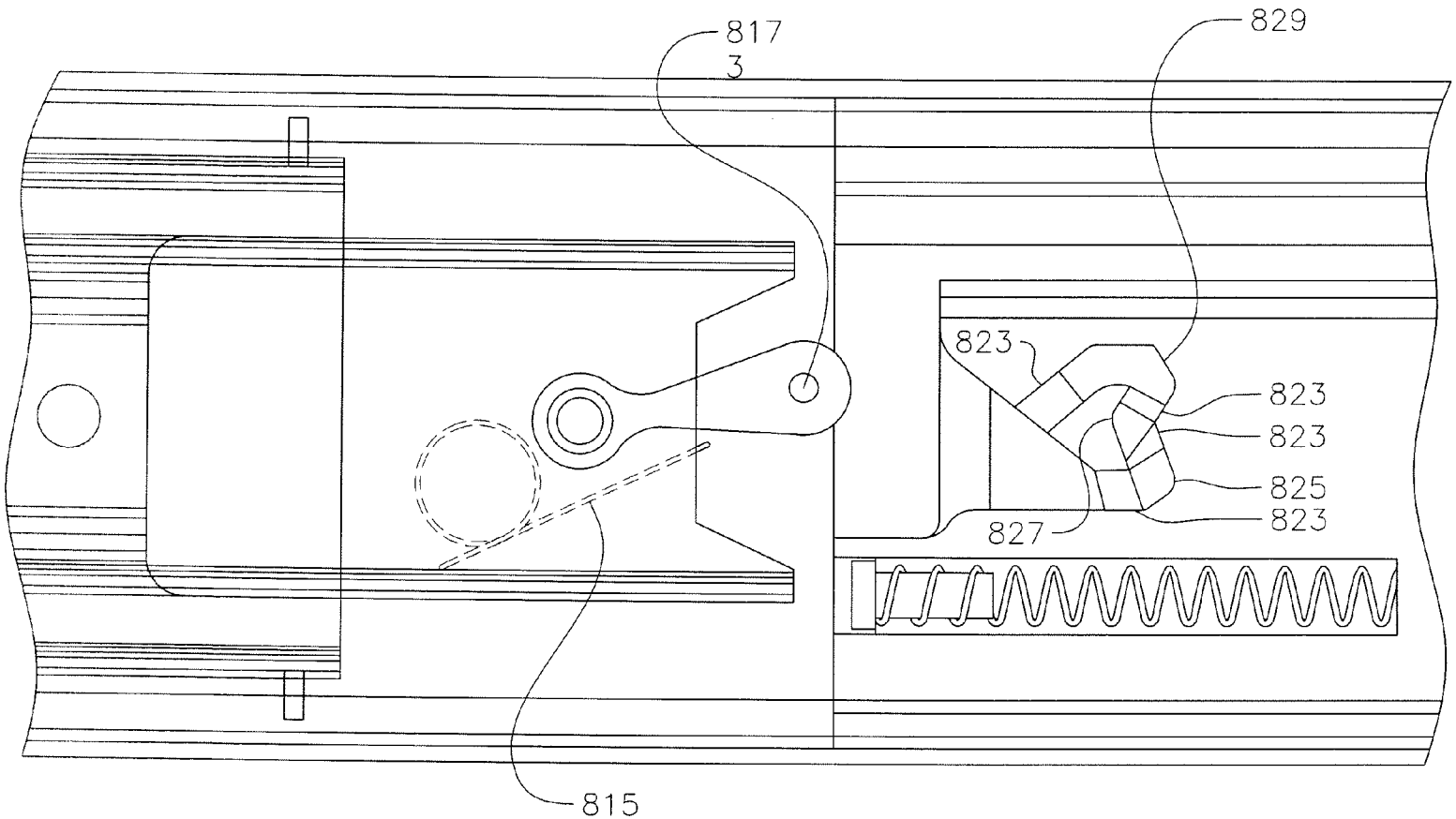

FIGS. 8*a* and 8*b* illustrate a further embodiment in accordance with aspects of the invention. In FIG. 8*a* an arm 811 extends rearward from the web of the inner slide member. The arm pivots about a pivot point 813 to which the arm is pivotably attached. As may be seen in FIG. 8*b*, the arm is normally biased towards a first position by a spring 815.

The arm includes a pin (a base 817 of which may be seen in FIG. 8*a*) approximate its forward end (rearward end if one considers the forward end of the arm to be approximate the pivot point). The pin extends towards the intermediate and outer slide members. As the slide is moved towards the closed position the pin enters a cutout which has some similarities to the cutout of the embodiment of FIGS. 7*a* and 7*b* in that the cutout forms a somewhat circular path 819 about an island 820, with a funnel 821 leading towards the somewhat circular path. More particularly, in the embodiment of FIGS. 8*a* and 8*b* the cutout forms a segmented somewhat circular path. The path is segmented as the path includes ledges, or ramps 823 in the illustrated embodiment, preventing reverse motion of the pin along the path. As the drawer slide closes, the pin contacts and rides against an edge of the funnel.

Thus, the cutout includes a large funnel opening. As the drawer slide closes the pin contacts and rides against an edge of the funnel. The funnel opening narrows to a gap between an edge of the cutout and an island in the middle of the cutout. A ledge is formed in the cutout. A first curve 825 is provided in the somewhat circular path after the top of the funnel, the first curve providing a rear stop to movement of the pin. The first curve also forces the pin towards the center of the somewhat circular path, and behind a rear notched edge 827 of the island. Release of the inner slide member with the pin in this position causes the pin, due to forward urging provided by a longitudinal spring of a slot in the guide block which interacts with a portion of the inner slide member, to urge the inner slide member forward.

The pin is released from the rear notch by application of force to the inner slide member directing it towards the rear of the outer slide member. This force also causes the pin to displace from the notch and, through the combination of a second curve in the semicircular path and the ramp slope formed in a semicircular path approximate the notch, to cause the pin to continue to traverse the semicircular path towards a second rear stop 829. Release of the inner slide member with the pin in the second rear stop allows the longitudinal spring to urge the inner slide member, and thus the pin, forward to complete passage through the semicircular path and concomitant release of the pin from the latch. In completing passage through the path the pin passes over a final ramp with an upward slope. The upward slope of the ramp serves to raise the outlet of the path over the surface of the cutout defined by the funnel, such that the edge of the funnel is not broken sufficient for the pin to inadvertently enter the path at its outlet.

Referring to FIG. 9, an undermount drawer slide 1000 is shown that includes a push-latch device constructed in accordance with the present disclosure. The drawer slide 1000 includes an outer slide member 1111 and an inner slide member 1115 which is slidably mounted to the outer slide member 1111. The drawer slide may also include an intermediate slide (not shown) slidably mounted on the outer slide member 1111, upon which the inner slide member 1115 is mounted and slides. The outer slide member 1111 includes an upper portion 1116*a* and a lower portion 1116*b* configured to form an L-shaped longitudinal web 1123. The upper portion 1116*a* may be in the form of a plate so as to provide attachment of the outer slide member 1111 to a side wall of a cabinet (not shown). The inner slide member 1115 is slidably mounted to the lower portion 1116*b* so as to be able to extend relative to the outer slide member 1111. The inner slide member 1115 can be connected to underneath a drawer (not shown) to provide extension of the drawer relative to the outer slide member 1111, and hence relative to the cabinet. In FIG. 9, the front portion of the drawer slide is shown. Accordingly, the inner slide member 1115 extends relative to the outer slide member 1111 in the direction of the arrow 1117.

The drawer slide includes a push latch device having a guide block 1129 and a bracket 1130, the functions of which are described below. The outer slide member 1111 carries the guide block 1129, which can be coupled or attached to the web 1123 with or without fasteners. The bracket 1130 may be connected to the inner slide member 1115 such that it moves with the inner slide member 1115 relative to the guide block 1129. The bracket 1130 can engage the guide block 1129 to latch the inner slide member 1115 to the outer slide member 1111 and disengage the bracket 1130 from the guide block 1129 to provided movement of the inner slide member 1115 relative to the outer slide member 1111.

Figure 10:
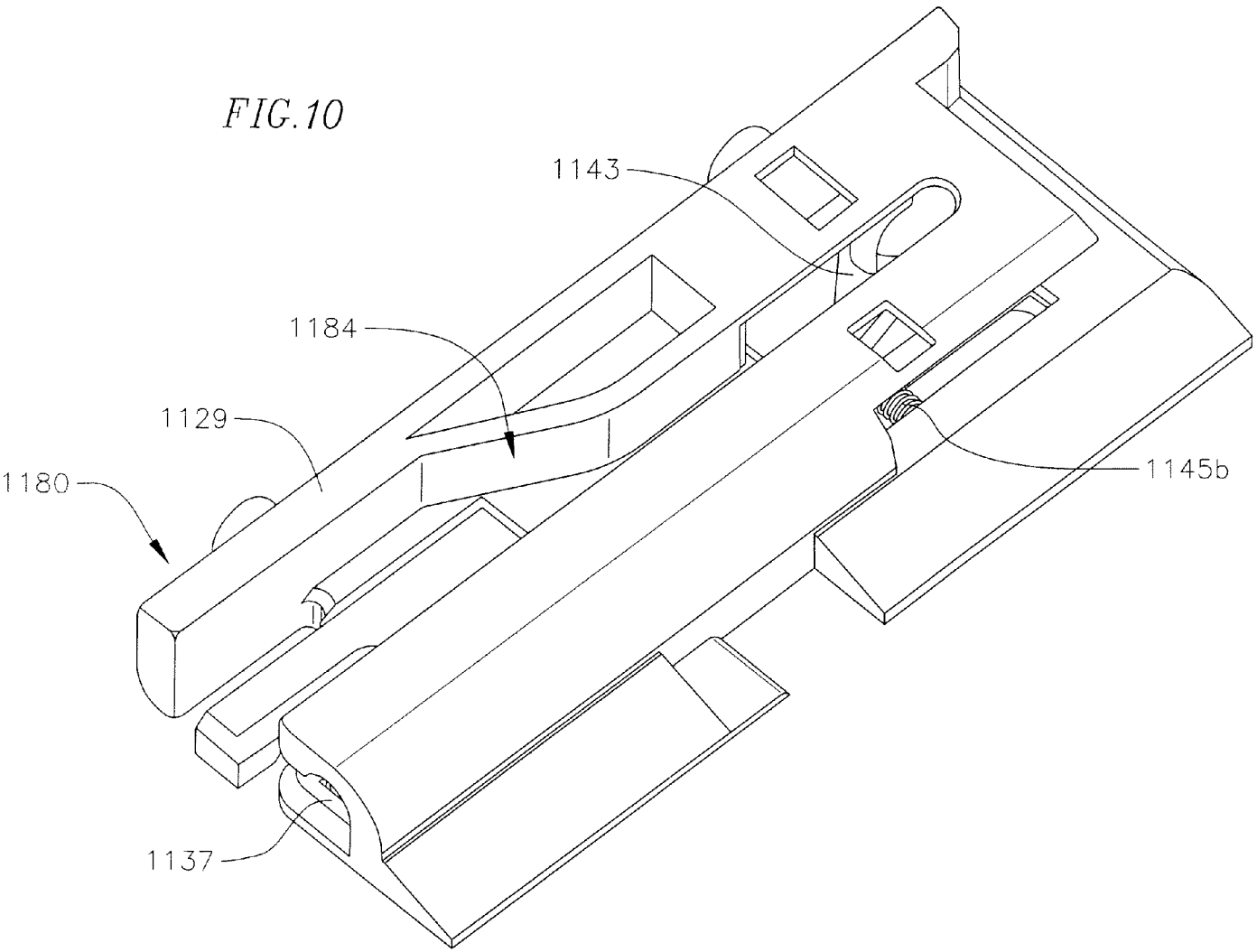
FIG. 10 illustrates a front perspective view of a guide block for the push-latch device of FIG. 9.

Referring to FIGS. 10 and 11, perspective views of an outer side 1180 and an inner side 1182 of the guide block 1129 are shown, respectively. The outer side 1180 includes a slotted guide path 1184 that narrows from a front side toward a rear side of the guide block 1129. The guide block 1129 includes a slotted cavity 1137 in which a spring 1139 is housed. The spring 1139 may include a cap 1259. As shown in FIG. 11, a moveable body 1143 is moveably mounted in a window 1141 of the guide block 1129. The moveable body 1143 can move in the window 1141 along an axis transverse to the longitudinal length and direction of extension of the slide. The movement of the moveable body 1143 is biased by the springs 1145*a* and 1145*b*. The guide block 1129 includes a pair of spaced apart slots 1330 at the window 1141, in which two spaced apart legs 1331*a* and 1331*b* (which are similar to legs 331*a* and 331*b* of the moveable body 143 of FIGS. 3*a* and 3*b*) of the moveable body 1143 are accommodated to guide the movement of the moveable body 1143. The moveable body 1143 is similar to the moveable body 143 of FIGS. 3*a* and 3*b* and parts of the moveable body 1143 are referred to herein with the same reference numbers as parts of the moveable body 143. Accordingly, details of the moveable body 1143, which are presented above with respect to the embodiment of FIGS. 3*a* and 3*b* are not repeated herein for brevity.

Figure 12:
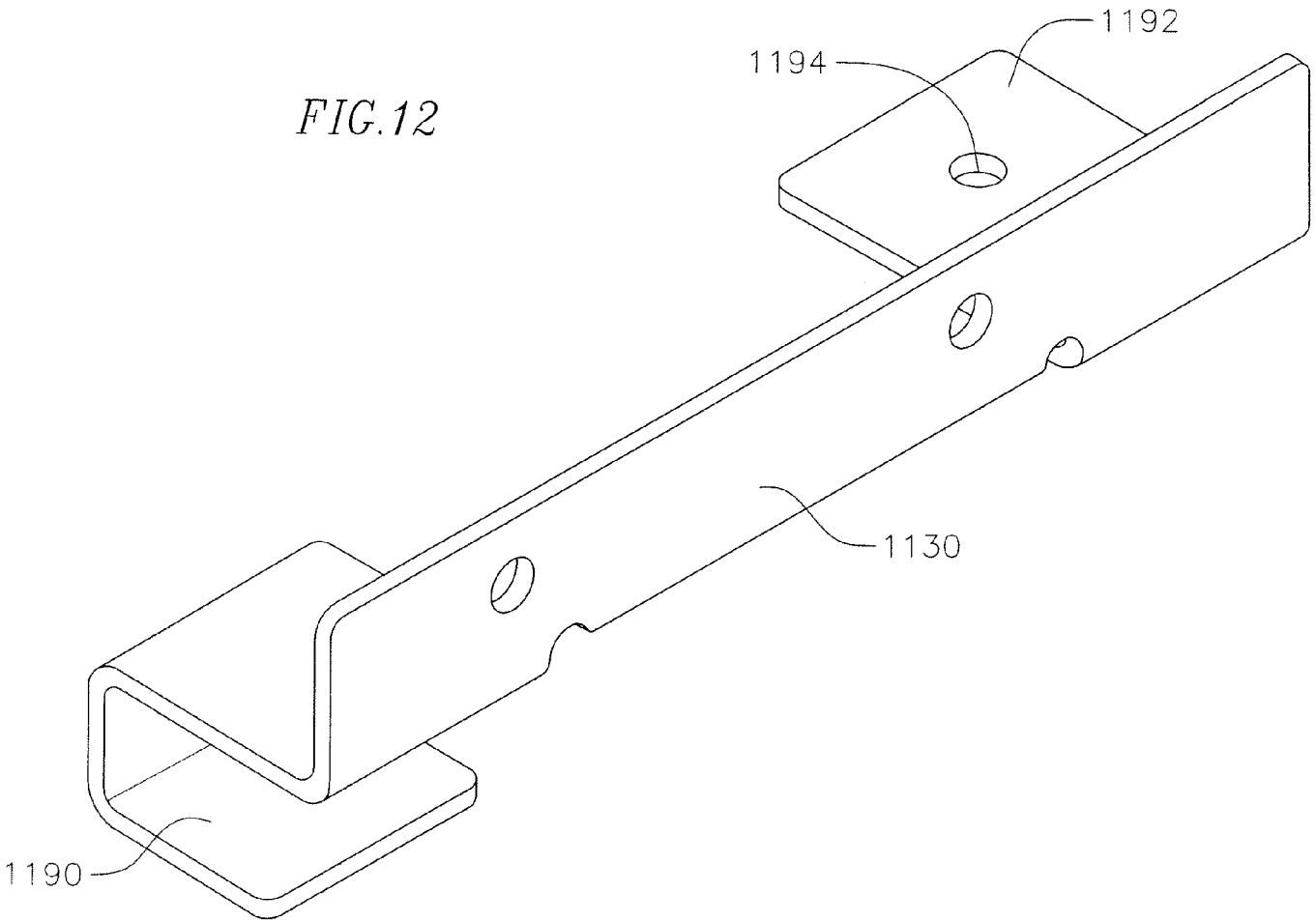
FIG. 12 illustrates a perspective view of a bracket of the push-latch device of FIG. 9.

Referring to FIG. 12, the bracket 1130 is shown in more detail. The bracket 1130 includes a U-shaped channel 1190 at one end and an upright tab 1192 at the other end. The upright tab 1192 includes a pin (not shown) projecting outward from the tab 1192. A base 1194 of the pin is shown in FIG. 12. Referring back to FIG. 9, the bracket 1130 can be connected to the inner slide member 1115 such that the pin can engage the moveable body 1143 through the slotted guide path 1184. Accordingly, the U-shaped channel 1190 can traverse in the slotted cavity 1137 to compress the spring 1139. The bracket 1130 represents one example of providing a pin for the inner slide member 1115 for engagement with the moveable body 1143 and a structure to engage the spring 1139. In other embodiments, different brackets or other mounting components are used.

Referring to FIGS. 9-11, when the inner slide member 1115 is moved toward a closed position, the pin (not shown) extending outward from the base 1194 (shown as an aperture) enters the slotted guide path 1184 of the guide block 1129. The funnel shape of the slotted guide path 1184 provides guiding of the pin toward the moveable body 1143. The guiding of the pin in the guide path 1184 provides appropriate positioning between the inner slide member 1115 and the outer slide member 1111 so that the drawer is positioned properly relative to the cabinet when the drawer is closed. Additionally, the narrowed portion of the guide path 1184 prevents side-to-side (i.e., lateral) movement of the drawer when the drawer is closed. Accordingly, the guide path 1184 can ensure that the drawer will consistently close at the same lateral position. Furthermore, as shown in FIG. 9, the U-shaped channel 1190 enters the slotted cavity 1137 and compresses the spring 1139.

The engagement of the moveable body 1143 with the pin is similar to that described above in relation to the first embodiment. The moveable body 1143 interacts with the pin (not shown) that extends from the upright tab 1192 of the bracket 1130. Accordingly, the pin approaches the moveable body 1143 of the guide block 1129 as the inner slide member 1115 moves towards the closed position. As the inner slide member 1115 closes, the pin contacts the moveable body 1143, causing the moveable body 1143 to displace from its neutral position. Once the moveable body 1143 is sufficiently displaced, it can retain the pin, thereby keeping the inner slide member 1115 in the closed position. Forcing the inner slide member 1115 further past the closed position allows the moveable body 1143 to return to its neutral position and release the pin. Accordingly, the force of the spring 1139 forces the inner slide member 1115 to extendably translate with respect to the outer slide member 1111.

Similar to the guide block 129 of FIG. 2, as shown in FIG. 11, the first spring 1145*a* is positioned towards the rear of the movable body 1143. The first spring 1145*a* is also coiled around a post 1263*a*, which maintains the position of the spring 1145*a* with respect to the moveable body 1143. The second spring 1145*b* is positioned towards the front of the moveable body 1143. The second spring 1145*b* is also coiled around a post 1263*b*, which maintains the position of the spring 1145*b* with respect to the moveable body 1143. The posts 1263*a,b* may be accommodated in corresponding cavities of the moveable body 1143. Thus, similar to the embodiment of FIG. 2, in the embodiment of FIG. 11, the spring 1145*a* is not axially aligned with the spring 1145*b*.

Figure 13:
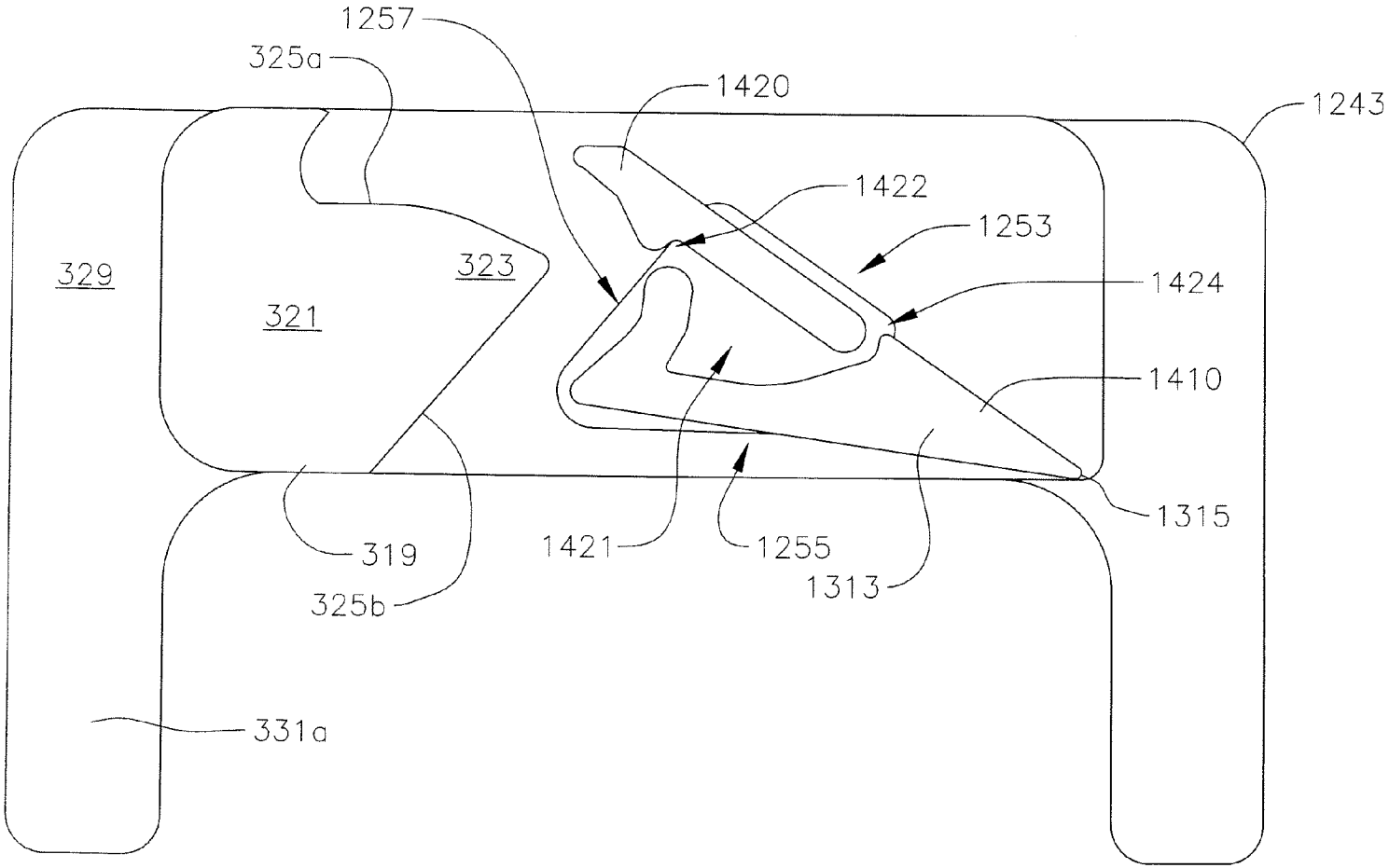
FIG. 13 illustrates another embodiment of a moveable body in accordance with aspects of the invention.

Referring to FIG. 13, another embodiment of a moveable body is shown. The moveable body 1243 is in many respects similar to the moveable body 143 of FIGS. 3*a* and 3*b*. Accordingly, in FIGS. 3*a*, 3*b* and 13, similar parts are represented with similar reference numbers. The moveable body 1243 includes a two-piece front projection 1313 having a lower piece 1410 and an upper piece 1420. Both the lower piece 1410 and the upper piece 1420 are constructed from a flexible material. The upper piece 1420 is spaced apart from the lower piece 1410 to define a cavity 1421 therebetween. The cavity 1421 is accessible through a rear gap 1422 and a front gap 1424. The two pieces 1410 and 1420 define a ramp 1253, a ramp 1255 and a concave depression 1257, which function similar to the ramp 253, ramp 255 and the concave depression 257 of FIGS. 1, 3*a* and 3*b*, respectively.

Similar to the operation of the moveable body 143, the pin of the inner slide member 115,1115 is positioned in the concave depression 1257 of the moveable body when the inner slide 115,1115 is in the closed position. Also as described above, as the inner slide 115,1115 is moved past the closed position, the pin moves out of the concave depression 1257 and slides along the ramp 1255 to allow the inner slide 115, 1115 to extend relative to the outer slide 111,1111. However, the moveable body 1243 provides for releasing the pin from the concave depression 1257 should the herein described unlatching mechanism malfunction. If the pin cannot be released from the concave depression 1257, the inner slide 115, 1115 can be pulled outward or opposite the closing direction. Because the two pieces 1410 and 1420 are flexible, the noted pulling causes the pin to enter the cavity 1421 through the rear gap 1422. Continued pulling causes the pin to exit the cavity 1421 through the front gap 1424, thus releasing the pin from the moveable body 1243. Accordingly, the moveable body 1243, with the flexible pieces 1410 and 1420 provides for releasing of the inner slide member 115, 1115 from the outer slide member 111, 1111 should the latching mechanism described herein malfunction.

The components of the drawer slides 100, 1000 can be constructed from a variety of metal and plastic materials. In high temperature applications of the drawer slides, the components can be constructed from metal. Furthermore, for the above described moveable body 1243, the front projection 1313 can be constructed from a flexible plastic material to provide the flexible functionality described herein.

Accordingly, aspects of the invention provide a drawer slide and a latching mechanism. Although the invention has been described with respect to certain specific embodiments, it should be recognized that the invention comprises the claims and their insubstantial variations supported by this disclosure.

What is claimed is:

1. A drawer slide comprising:

an outer slide having a length and a width, said width being generally parallel to a surface that said drawer slide will be mounted on;

an inner slide having a length and a width, said width being generally parallel to a surface that said drawer slide will be mounted on, said inner slide member being moveable in a lengthwise direction between a retracted closed position and an extended position relative to the outer slide;

a first engagement member;

a second engagement member mounted to one of said inner and outer slides, said second engagement member being moveable relative to and along the width of said one of said inner and outer slide members to which it is mounted on, said second engagement member being moveable between a latched position to latch the inner slide in the closed position and an unlatched position disengaged from the first engagement member;

at least a first spring configured to bias the inner slide to the extended position when the inner slide is proximate to the closed position, wherein when in the unlatched position, the second engagement member is moveable independently of said at least a first spring; and a second spring configured to bias the second engagement member.

2. The drawer slide of claim 1, wherein the first engagement member is coupled to the inner slide and the second engagement member is coupled to the outer slide.

3. The drawer slide of claim 1, wherein the first engagement member is coupled to the outer slide and the second engagement member is coupled to the inner slide.

4. The drawer slide of claim 1, wherein the first engagement member is mounted on a web of the inner slide.

5. The drawer slide of claim 1, further comprising a bracket connected to the inner slide, wherein the first engagement member is mounted on the bracket.

6. The drawer slide of claim 1, further comprising a guide block connected to the outer slide, wherein the second engagement member is moveably mounted to the guide block.

7. The drawer slide of claim 6, wherein the guide block comprises at least one slotted cavity for housing the at least first spring.

8. The drawer slide of claim 6, wherein the guide block includes a longitudinal slot forward of the second engagement member, the longitudinal slot configured to guide the first engagement member to the second engagement member when the inner slide is moved from the extended position to the closed position.

9. The drawer slide of claim 8, wherein the longitudinal slot is configured to substantially prevent lateral movement of the inner slide member relative to the outer slide member.

10. The drawer slide of claim 1, wherein the second spring is configured to bias the second engagement member in a first direction, the drawer slide further comprising a third spring configured to bias the second engagement member in a second direction, wherein the first direction is opposite to the second direction.

11. The drawer slide of claim 1, wherein the second engagement member comprises:

a front projection comprising a rear depression and a ramped surface configured to slidably engage with the first engagement member; and a rear finger spaced apart from the rear depression;

wherein the rear depression and the rear finger define a basin configured to guide the first engagement member between the latched position of the second engagement member and the unlatched position of the second engagement member.

12. A drawer slide comprising:

an outer slide having a length and a width, said width being generally parallel to a surface that said drawer slide will be mounted on;

an inner slide having a length and a width, said width being generally parallel to a surface that said drawer slide will be mounted on, said inner slide being moveably coupled to the outer slide and moveable lengthwise between a retracted closed position and an extended position relative to the outer slide;

a first engagement member coupled to the inner slide;

a guide block coupled to the outer slide, the guide block comprising:

at least a first spring configured to bias the inner slide to the extended position when the inner slide is proximate to the closed position;

a second engagement member moveable in a first direction and a second direction along the width of said outer slide independently of said at least a first spring, the second direction being opposite the first direction, the second engagement member having a ramped front projection configured to engage the first engagement member and a basin disposed to the rear of the front projection and configured to receive the first engagement member;

at least a second spring configured to bias the movement of the second engagement member in any one of the first direction and the second direction; and wherein the first engagement member is configured to move the second engagement member in the first direction by the first engagement member sliding along the ramped front projection against the bias of the at least one second spring as the inner slide is moved proximate to the closed position;

wherein the first engagement member is received in the basin when the inner slide is in the closed position; and wherein the first spring biases the inner slide to the extended position when the first engagement member is outside the basin.

13. The drawer slide of claim 12, wherein the first engagement member is mounted on a web of the inner slide.

14. The drawer slide of claim 12, further comprising a bracket connected to the inner slide, wherein the first engagement member is mounted on the bracket.

15. The drawer slide of claim 12, wherein the guide block comprises at least one slotted cavity for housing the at least first spring.

16. The drawer slide of claim 12, wherein the guide block includes a longitudinal slot forward of the second engagement member, the longitudinal slot configured to guide the first engagement member to the second engagement member when the inner slide is proximate to the closed position.

17. The drawer slide of claim 16, wherein the longitudinal slot is configured to substantially prevent lateral movement of the inner slide member relative to the outer slide member.

18. The drawer slide of claim 12, further comprising a third spring configured to bias the second engagement member in the second direction, wherein the second spring is configured to bias the second engagement member in the first direction.

19. A drawer slide comprising:

an outer slide having a length and a width said width being generally parallel to a surface that said drawer slide will be mounted;

an inner slide having a length and a width said width being generally parallel to a surface that said drawer slide will be mounted on, said inner slide member being moveable relative to the outer slide along a lengthwise direction between a retracted closed position and an extended position relative to the outer slide;

means for latching and unlatching the inner slide relative to the outer slide, the means for latching and unlatching comprising a first engagement member configured to move along the extension direction and a second engagement member configured to move transverse to the extension direction along the width of said inner or outer slide, the first engagement member configured to engage with the second engagement member in the closed position and configured to disengage from the second engagement member in the extended position;

at least a first spring coupled to any one of the outer slide and the inner slide and configured to bias the inner slide to the extended position when the inner slide is proximate to the closed position, wherein when the first and second engagement members are disengaged, the second engagement member is moveable independently of said at least a first spring; and at least a second spring configured to bias the second engagement member.

20. The drawer slide of claim 19, wherein the first engagement member is coupled to the inner slide and the second engagement member is coupled to the outer slide.

21. The drawer slide of claim 19, wherein the first engagement member is coupled to the outer slide and the second engagement member is coupled to the inner slide.

22. The drawer slide of claim 19, wherein the engagement of the first engagement member and the second engagement member are configured to substantially prevent lateral movement of the inner slide member relative to the outer slide member.

23. The drawer slide of claim 19, wherein the inner slide is moveable relative to the outer slide along a path, and wherein the at least a second spring is configured to bias the movement of the second engagement member transverse to path.

24. A drawer slide comprising:

an outer slide having a length and a width, said width being generally parallel to a surface that said drawer slide will be mounted on;

an inner slide having a length and a width, said width being generally parallel to a surface that said drawer slide will be mounted on, said inner slide member being moveable in a lengthwise direction between a retracted closed position and an extended position relative to the outer slide;

a first engagement member;

a second engagement member mounted to one of said inner and outer slides, said second engagement member being moveable relative to and along the width of said one of said inner and outer slide members to which it is mounted on, said second engagement member being moveable between a latched position to latch the inner slide in the closed position and an unlatched position disengaged from the first engagement member, wherein the second engagement member comprises, a front projection comprising a rear depression and a ramped surface configured to slidably engage with the first engagement member, and a rear finger spaced apart from the rear depression, wherein the rear depression and the rear finger define a basin configured to guide the first engagement member between the latched position of the second engagement member and the unlatched position of the second engagement member; and at least a first spring configured to bias the inner slide to the extended position when the inner slide is proximate to the closed position, wherein when in the unlatched position, the second engagement member is moveable independently of said at least a first spring.

* * * * *